US012808192B2

(12) United States Patent
Kiik et al.

(10) Patent No.: US 12,808,192 B2
(45) **Date of Patent: *Nov. 24, 2026**

(54) ASPHALT SHINGLE WASTE COATINGS IN ROOFING MATERIALS

(71) Applicant: BMIC LLC, Dallas, TX (US)

(72) Inventors: Matti Kiik, Dallas, TX (US); Richard A. Nowak, Dallas, TX (US)

(73) Assignee: BMIC LLC, Dallas, TX (US)

( * ) Notice: Subject to any disclaimer, the term of this patent is extended or adjusted under 35 U.S.C. 154(b) by 182 days.

This patent is subject to a terminal disclaimer.

(21) Appl. No.: 18/941,972

(22) Filed: Nov. 8, 2024

(65) Prior Publication Data

US 2025/0146282 A1 May 8, 2025

Related U.S. Application Data

(63) Continuation of application No. 18/481,716, filed on Oct. 5, 2023, now Pat. No. 12,168,873, which is a continuation of application No. 18/331,806, filed on Jun. 8, 2023, now Pat. No. 11,795,691, which is a continuation of application No. 17/970,416, filed on Oct. 20, 2022, now Pat. No. 11,713,578, which is a continuation of application No. 17/675,913, filed on Feb. 18, 2022, now Pat. No. 11,512,471.

(51) Int. Cl.
*E04D 1/20* (2006.01)
*D06N 5/00* (2006.01)

(52) U.S. Cl.
CPC ..... *E04D 1/20* (2013.01); *D06N 5/003* (2013.01)

(58) Field of Classification Search
CPC .... E04D 1/12; E04D 1/20; E04D 1/26; E06N 5/003; D06N 5/00
See application file for complete search history.

(56) References Cited

U.S. PATENT DOCUMENTS

| | | | |
|---|---|---|---|
| 3,026,568 | A | 3/1962 | Moar |
| 5,209,802 | A | 5/1993 | Hannah et al. |
| 6,120,838 | A | 9/2000 | Zickell |
| 6,228,503 | B1 | 5/2001 | Zickell |
| 6,743,313 | B2 | 6/2004 | Mischo |
| 6,984,670 | B2 | 1/2006 | Meyers, III et al. |
| 7,052,635 | B2 | 5/2006 | Mischo |
| 7,297,301 | B1 | 11/2007 | Deschamps et al. |
| 7,891,590 | B2 | 2/2011 | Rasmussen |
| 7,913,940 | B2 | 3/2011 | Harmon |

(Continued)

FOREIGN PATENT DOCUMENTS

| | | |
|---|---|---|
| WO | 2018/094315 A2 | 5/2018 |
| WO | 2018/125952 A2 | 7/2018 |
| WO | 2019/134729 A1 | 7/2019 |

*Primary Examiner* — Chi Q Nguyen
(74) *Attorney, Agent, or Firm* — GREENBERG TRAURIG, LLP

(57) ABSTRACT

Some embodiments relate to asphalt shingle waste coatings in roofing shingles of roofing systems. A roofing system comprises a plurality of roofing shingles. The plurality of roofing shingles, when installed on a roof substrate, comprises exposed surfaces and unexposed surfaces. The plurality of roofing shingles comprises asphalt shingle waste coatings on or only on at least one of the unexposed surfaces. The plurality of roofing shingles comprises asphalt coatings on or only on at least one of the exposed surfaces.

20 Claims, 6 Drawing Sheets

(56) References Cited

U.S. PATENT DOCUMENTS

| | | | |
|---|---|---|---|
| 8,083,166 | B2 | 12/2011 | Gould et al. |
| 8,162,242 | B2 | 4/2012 | Hofmann et al. |
| 8,177,152 | B2 | 5/2012 | Harmon |
| 8,186,610 | B2 | 5/2012 | Gould et al. |
| 8,210,458 | B2 | 7/2012 | Strasser et al. |
| 8,266,861 | B2 | 9/2012 | Koch et al. |
| 8,388,873 | B2 | 3/2013 | Hofmann et al. |
| 8,496,196 | B2 | 7/2013 | Zickell et al. |
| 8,672,248 | B2 | 3/2014 | Zickell et al. |
| 8,673,427 | B2 | 3/2014 | Kalkanoglu et al. |
| 8,783,590 | B2 | 7/2014 | Zickell et al. |
| 8,789,773 | B2 | 7/2014 | Teeter, Jr. et al. |
| 8,919,681 | B1 | 12/2014 | Horton et al. |
| 9,156,035 | B1 | 10/2015 | Horton et al. |
| 9,227,196 | B2 | 1/2016 | Hassan et al. |
| 9,273,228 | B1 | 3/2016 | Hyer et al. |
| 9,295,992 | B2 | 3/2016 | Zickell |
| 9,382,423 | B2 | 7/2016 | Bolton et al. |
| 9,440,239 | B1 | 9/2016 | Horton et al. |
| 9,457,354 | B2 | 10/2016 | Svec et al. |
| 9,550,311 | B1 | 1/2017 | Neel |
| 9,834,895 | B2 | 12/2017 | Neel |
| 9,855,677 | B2 | 1/2018 | Brock et al. |
| 9,951,223 | B2 | 4/2018 | Gillespie et al. |
| 9,951,224 | B2 | 4/2018 | Russell |
| 10,196,783 | B2 | 2/2019 | Dempsey et al. |
| 10,323,149 | B2 | 6/2019 | Russell |
| 10,683,620 | B1 | 6/2020 | Kelley et al. |
| 11,059,976 | B2 | 7/2021 | Franzen et al. |
| 12,054,949 | B2 * | 8/2024 | Kiik ..... D06N 5/003 |
| 12,168,873 | B2 * | 12/2024 | Kiik ..... E04D 1/20 |
| 12,264,476 | B2 * | 4/2025 | LaTorre ..... B32B 11/02 |
| 2002/0066813 | A1 | 6/2002 | Mischo |
| 2008/0184661 | A1 | 8/2008 | Lombard |
| 2008/0314803 | A1 | 12/2008 | Burke |
| 2010/0064937 | A1 | 3/2010 | Harmon et al. |
| 2011/0041731 | A1 | 2/2011 | Lombard |
| 2013/0199410 | A1 | 8/2013 | Maldonado et al. |
| 2013/0220175 | A1 | 8/2013 | Zickell |
| 2013/0307172 | A1 | 11/2013 | Seder et al. |
| 2013/0313344 | A1 | 11/2013 | Nykulin et al. |
| 2014/0014000 | A1 | 1/2014 | Franzen et al. |
| 2014/0299018 | A1 | 10/2014 | Elseifi et al. |
| 2014/0331897 | A1 | 11/2014 | Elseifi |
| 2014/0373749 | A1 | 12/2014 | Zickell et al. |
| 2015/0252534 | A1 | 9/2015 | Dempsey et al. |
| 2016/0362339 | A1 | 12/2016 | Franzen et al. |
| 2018/0141866 | A1 | 5/2018 | Kotefski et al. |
| 2018/0186963 | A1 | 7/2018 | Kotefski et al. |
| 2018/0208771 | A1 | 7/2018 | Gillespie et al. |
| 2018/0243798 | A1 | 8/2018 | Abraham et al. |
| 2018/0334620 | A1 | 11/2018 | Kotefski et al. |
| 2019/0039105 | A1 | 2/2019 | Burns, Sr. et al. |
| 2019/0300427 | A1 | 10/2019 | Horton |
| 2019/0375940 | A1 | 12/2019 | Franzen et al. |
| 2025/0146282 | A1 * | 5/2025 | Kiik ..... E04D 1/20 |
| 2026/0132630 | A1 * | 5/2026 | Kiik ..... E04D 1/20 |

* cited by examiner

ASPHALT SHINGLE WASTE COATINGS IN ROOFING MATERIALS

RELATED APPLICATIONS

The present application is a continuation of U.S. patent application Ser. No. 18/481,716, filed Oct. 5, 2023, now U.S. Pat. No. 12,168,873, which is a continuation of U.S. patent application Ser. No. 18/331,806, filed Jun. 8, 2023, now U.S. Pat. No. 11,795,691, which is a continuation of U.S. patent application Ser. No. 17/970,416, filed Oct. 20, 2022, now U.S. Pat. No. 11,713,578, which is a continuation of U.S. patent application Ser. No. 17/675,913, filed Feb. 18, 2022, now U.S. Pat. No. 11,512,471, the contents of which are incorporated herein by reference in their entirety for all purposes.

FIELD

This disclosure generally relates to asphalt shingle waste coatings in roofing materials, such as, for example and without limitation, roofing shingles, and related systems.

BACKGROUND

Approximately 11 million tons of asphalt shingle waste (ASW) are generated in the U.S. each year. Asphalt shingle waste can take time to decompose in a landfill.

SUMMARY

Some embodiments relate to a roofing system. In some embodiments, the roofing system comprises at least one of a roof substrate, at least one roofing shingle, or any combination thereof. In some embodiments, the roof substrate comprises at least one of a roof deck, an underlayment, or any combination thereof. In some embodiments, the at least one roofing shingle comprises a plurality of roofing shingles. In some embodiments, the plurality of roofing shingles comprises a first roofing shingle, a second roofing shingle, and a third roofing shingle on the roof substrate. In some embodiments, the first roofing shingle covers a portion of the second roofing shingle so as to define first unexposed surfaces and first exposed surfaces. In some embodiments, the second roofing shingle covers a portion of the third roofing shingle so as to define second unexposed surfaces and second exposed surfaces. In some embodiments, at least the first roofing shingle, the second roofing shingle, and the third roofing shingle comprise an asphalt shingle waste filled coating on at least one of the first unexposed surfaces, at least one of the second unexposed surfaces, or any combination thereof. In some embodiments, the asphalt shingle waste filled coating comprises a mixture of an asphalt shingle waste and at least one filler. In some embodiments, at least the first roofing shingle, the second roofing shingle, and the third roofing shingle comprise an asphalt coating on at least one of the first exposed surfaces, at least one of the second exposed surfaces, or any combination thereof. In some embodiments, the asphalt coating may be free or substantially free of the asphalt shingle waste.

In some embodiments, the asphalt shingle waste filled coating comprises 10% to 70% by weight of the at least one filler based on a total weight of the asphalt shingle waste filled coating, with a remainder of the asphalt shingle waste filled coating comprising the asphalt shingle waste.

In some embodiments, the asphalt shingle waste filled coating further comprises asphalt.

In some embodiments, the asphalt shingle waste filled coating comprises 1% to 99% by weight of asphalt shingle waste based on a total weight of the asphalt and the asphalt shingle waste; and 1% to 99% by weight of asphalt based on the total weight of the asphalt and the asphalt shingle waste.

In some embodiments, each of the first roofing shingle, the second roofing shingle, and the third roofing shingle comprises a sheet having a top surface and a back surface. In some embodiments, the entire top surface comprises the asphalt coating. In some embodiments, the entire back surface comprises the asphalt shingle waste filled coating.

In some embodiments, each of the first roofing shingle, the second roofing shingle, and the third roofing shingle comprises a top sheet and a back sheet. In some embodiments, the top sheet comprises a headlap and a plurality of tabs extending from a side of the headlap. In some embodiments, the headlap comprises an unexposed front surface and an unexposed back surface. In some embodiments, the plurality of tabs comprises an exposed front surface and an unexposed back surface. In some embodiments, the back sheet may be attached to the top sheet. In some embodiments, the back sheet underlies the plurality of tabs such that the back sheet comprises a front surface and an unexposed back surface. In some embodiments, the front surface comprises an exposed front surface between the plurality of tabs. In some embodiments, the front surface comprises an unexposed front surface covered by the plurality of tabs.

In some embodiments, the asphalt shingle waste filled coating may be disposed only on at least one of the unexposed front surface of the headlap of the first roofing shingle, the unexposed front surface of the headlap of the second roofing shingle, the unexposed front surface of the headlap of the third roofing shingle, the unexposed back surface of the headlap of the first roofing shingle, the unexposed back surface of the headlap of the second roofing shingle, the unexposed back surface of the headlap of the third roofing shingle, the unexposed back surface of the plurality of tabs of the first roofing shingle, the unexposed back surface of the plurality of tabs of the second roofing shingle, the unexposed back surface of the plurality of tabs of the third roofing shingle, the unexposed back surface of the back sheet of the first roofing shingle, the unexposed back surface of the back sheet of the second roofing shingle, the unexposed back surface of the back sheet of the third roofing shingle, or any combination thereof.

In some embodiments, the asphalt shingle waste filled coating may be disposed on at least one of the unexposed front surface of the headlap of the first roofing shingle, the unexposed front surface of the headlap of the second roofing shingle, the unexposed front surface of the headlap of the third roofing shingle, or any combination thereof.

In some embodiments, the asphalt shingle waste filled coating may be disposed on at least one of the unexposed back surface of the headlap of the first roofing shingle, the unexposed back surface of the headlap of the second roofing shingle, the unexposed back surface of the headlap of the third roofing shingle, or any combination thereof.

In some embodiments, the asphalt shingle waste filled coating may be disposed on at least one of the unexposed back surface of the plurality of tabs of the first roofing shingle, the unexposed back surface of the plurality of tabs of the second roofing shingle, the unexposed back surface of the plurality of tabs of the third roofing shingle, or any combination thereof.

In some embodiments, the asphalt shingle waste filled coating may be disposed on at least one of the unexposed back surface of the back sheet of the first roofing shingle, the unexposed back surface of the back sheet of the second roofing shingle, the unexposed back surface of the back sheet of the third roofing shingle, or any combination thereof.

In some embodiments, the asphalt coating may be disposed only on at least one of the exposed front surface of the plurality of tabs of the first roofing shingle, the exposed front surface of the plurality of tabs of the second roofing shingle, the exposed front surface of the plurality of tabs of the third roofing shingle, the exposed front surface of the back sheet of the first roofing shingle, the exposed front surface of the back sheet of the second roofing shingle, the exposed front surface of the back sheet of the third roofing shingle, the unexposed front surface of the headlap of the first roofing shingle, the unexposed front surface of the headlap of the second roofing shingle, the unexposed front surface of the headlap of the third roofing shingle, the unexposed front surface of the back sheet of the first roofing shingle, the unexposed front surface of the back sheet of the second roofing shingle, the unexposed front surface of the back sheet of the third roofing shingle, or any combination thereof.

In some embodiments, the asphalt coating may be disposed on at least one of the exposed front surface of the plurality of tabs of the first roofing shingle, the exposed front surface of the plurality of tabs of the second roofing shingle, the exposed front surface of the plurality of tabs of the third roofing shingle, or any combination thereof.

In some embodiments, the asphalt coating may be disposed on at least one of the exposed front surface of the back sheet of the first roofing shingle, the exposed front surface of the back sheet of the second roofing shingle, the exposed front surface of the back sheet of the third roofing shingle, the unexposed front surface of the back sheet of the first roofing shingle, the unexposed front surface of the back sheet of the second roofing shingle, the unexposed front surface of the back sheet of the third roofing shingle, or any combination thereof.

In some embodiments, the asphalt coating may be disposed on at least one of the unexposed front surface of the headlap of the first roofing shingle, the unexposed front surface of the headlap of the second roofing shingle, the unexposed front surface of the headlap of the third roofing shingle, or any combination thereof.

Some embodiments relate to a roofing shingle. In some embodiments, the roofing shingle comprises a top sheet and a back sheet. In some embodiments, the top sheet comprises a headlap and a plurality of tabs extending from a side of the headlap. In some embodiments, the headlap comprises an unexposed front surface and an unexposed back surface. In some embodiments, the plurality of tabs comprises an exposed front surface and an unexposed back surface. In some embodiments, the back sheet may be attached to the top sheet. In some embodiments, the back sheet underlies the plurality of tabs such that the back sheet comprises a front surface and an unexposed back surface. In some embodiments, the front surface comprises an exposed front surface between the plurality of tabs. In some embodiments, the front surface comprises an unexposed front surface covered by the plurality of tabs. In some embodiments, the roofing shingle further comprises an asphalt shingle waste filled coating on at least one unexposed surface of at least one of the top sheet, the back sheet, or any combination thereof. In some embodiments, the asphalt shingle waste filled coating comprises a mixture of an asphalt shingle waste and at least one filler.

In some embodiments, the asphalt shingle waste filled coating comprises 10% to 70% by weight of the at least one filler based on a total weight of the asphalt shingle waste filled coating, with a remainder of the asphalt shingle waste filled coating comprising the asphalt shingle waste.

In some embodiments, the asphalt shingle waste filled coating further comprises asphalt.

In some embodiments, the asphalt shingle waste filled coating comprises 1% to 99% by weight of asphalt shingle waste based on a total weight of the asphalt and the asphalt shingle waste; and 1% to 99% by weight of asphalt based on the total weight of the asphalt and the asphalt shingle waste.

In some embodiments, the asphalt shingle waste filled coating may be disposed on at least one of the unexposed front surface of the headlap, the unexposed back surface of the headlap, the unexposed back surface of the plurality of tabs, or any combination thereof.

In some embodiments, the asphalt shingle waste filled coating may be disposed on the unexposed back surface of the back sheet.

In some embodiments, the roofing shingle further comprises an asphalt coating on at least one surface of at least one of the top sheet, the back sheet, or any combination thereof. In some embodiments, the asphalt coating may be free or substantially free of asphalt shingle waste.

In some embodiments, the asphalt coating may be disposed on at least one of the exposed front surface of the plurality of tabs, the exposed front surface of the back sheet, the unexposed front surface of the back sheet, the unexposed front surface of the headlap, or any combination thereof.

Some embodiments relate to a method for making a roofing shingle. In some embodiments, the method comprises obtaining a substrate. In some embodiments, the substrate comprises a first surface and a second surface. In some embodiments, the method comprises obtaining an asphalt coating formulation. In some embodiments, the asphalt coating formulation may be free or substantially free of asphalt shingle waste. In some embodiments, the method comprises obtaining an asphalt shingle waste filled coating formulation. In some embodiments, the asphalt shingle waste filled coating formulation comprises a mixture of an asphalt shingle waste and at least one filler. In some embodiments, the method comprises coating the first surface of the substrate with the asphalt coating formulation. In some embodiments, the method comprises coating the second surface of the substrate with the asphalt shingle waste filled coating formulation. In some embodiments, the method comprises forming a roofing shingle comprising the coated substrate. In some embodiments, the roofing shingle comprises at least one of a laminated shingle, a strip shingle, or any combination thereof.

In some embodiments, the forming comprises cutting the coated substrate to form the roofing shingle.

In some embodiments, the method further comprises applying roofing granules to at least a portion of the first surface of the substrate.

In some embodiments, the substrate comprises a fiberglass mat.

In some embodiments, the asphalt shingle waste filled coating formulation comprises 10% to 70% by weight of the at least one filler, with a remainder of the asphalt shingle waste filled coating formulation comprising the asphalt shingle waste.

In some embodiments, the asphalt shingle waste filled coating formulation further comprises asphalt.

In some embodiments, the asphalt shingle waste filled coating formulation comprises 1% to 99% by weight of asphalt shingle waste based on a total weight of the asphalt and the asphalt shingle waste; and 1% to 99% by weight of asphalt based on the total weight of the asphalt and the asphalt shingle waste.

BRIEF DESCRIPTION OF THE DRAWINGS

Reference is made to the drawings that form a part of this disclosure, and which illustrate embodiments in which the materials and methods described herein can be practiced.

DETAILED DESCRIPTION

Figure 1:
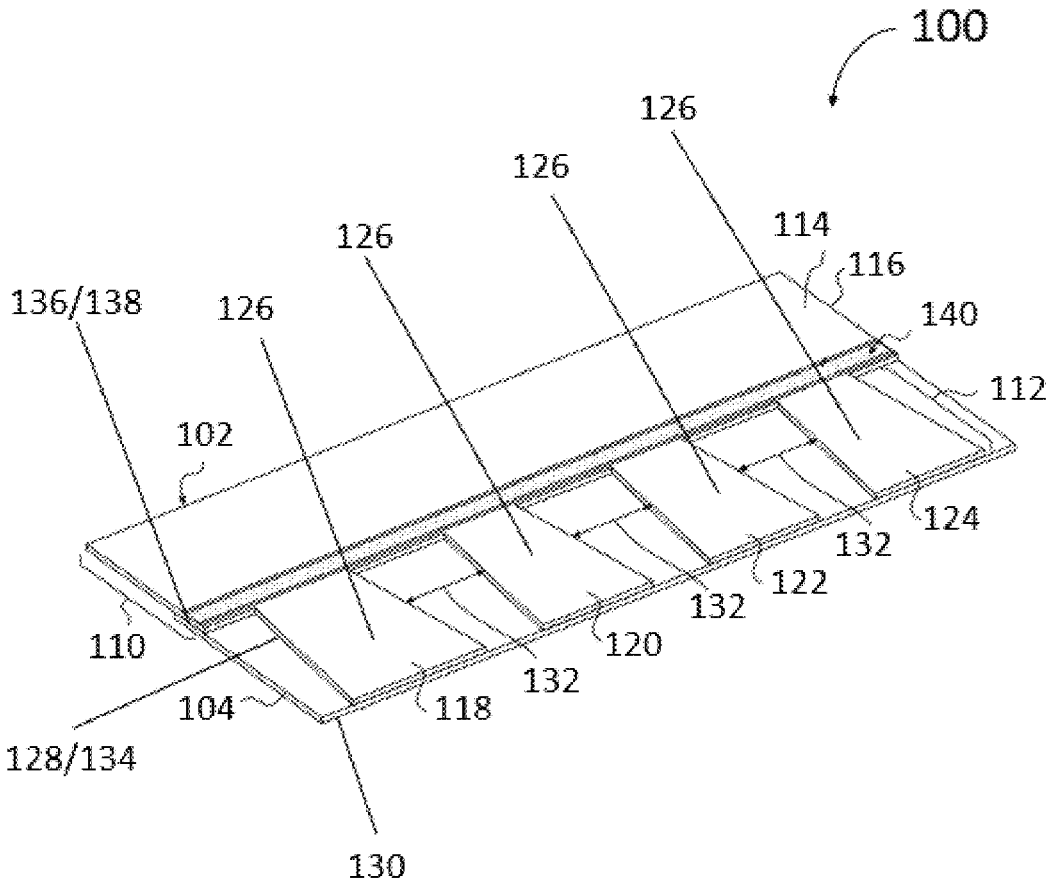
FIG. 1 is a schematic diagram of a perspective view of a roofing shingle, according to some embodiments.

As used herein, the term "asphalt shingle waste" refers to any form of discarded asphalt shingle. "Asphalt shingle waste" includes, but is not limited to, post-manufacturing waste and post-consumer waste.

As used herein, the term "post-consumer waste" refers to any waste produced by an end consumer of a material stream. A non-limiting example of "post-consumer waste" is a discarded roofing shingle from a residential or commercial roof. Another non-limiting example of "post-consumer waste" is contractor waste including, but not limited to, surplus new material, damaged material, and scrap from cut shingles during installation. Yet another non-limiting example of "post-consumer waste" is at least one of: distributor waste, retail waste, or any combination thereof, including, but not limited to, damaged shingle products, aged inventory of shingles, and customer returns.

As used herein, the term "post-manufacturing waste" refers to waste produced prior to reaching the end consumer of a material stream. A non-limiting example of "post-manufacturing waste" is any shingle waste generated during the production, handling, transportation or other method of generation prior to installation on a roof of a consumer. Post-manufacturing waste may include production waste such as, but not limited to, partial shingles and coated fiberglass mat with or without granules.

As used herein, the term "waste asphalt" refers to any form of asphalt that is obtained from asphalt shingle waste.

As used herein, the term "asphalt," when used without the modifier "waste," refers to any form of asphalt that is not obtained from asphalt shingle waste. Non-limiting examples of asphalt include virgin asphalt, such as, for example and without limitation, at least one of hot mix asphalt, warm mix asphalt, cold mix asphalt, sheet asphalt, high-modulus asphalt, or any combination thereof.

As used herein, the "oxidized asphalt" is defined as a form of processed asphalt that is created by oxidizing asphalt. A non-limiting example of an oxidation procedure is air-blowing, in which air is blown into asphalt at a sufficient temperature (e.g., from 450° F. to 500° F.) to oxidize the asphalt. Other non-limiting examples of oxidation procedures are described in U.S. Pat. Nos. 7,901,563 and 9,556,383, each of which are incorporated by reference in their entireties.

As used herein, the term "polymer modified asphalt coating" is defined as a form of processed asphalt that is created by adding at least one polymer to asphalt. A non-limiting example of a polymer modification procedure is emulsification, in which at least one polymer is mixed with asphalt at a sufficient temperature (e.g., from 250° F. to 350° F.) to form an emulsion. Other non-limiting examples of polymer modification procedures are described in U.S. Pat. No. 8,901,211, which is incorporated by reference in its entirety. In yet other embodiments, the polymer forms a colloid suspension, colloid solution, or dispersion with the asphalt.

As used herein, the term "unexposed surface" refers to a surface not exposed to an environment. As used herein, the term "exposed surface" refers to a surface exposed to an environment. In some embodiments, the unexposed surface and exposed surface may be defined in reference to a roofing shingle installed on a roof substrate. For example, in the roofing system embodiment, the unexposed surfaces of the roofing shingle correspond to surfaces not having direct exposure to the environment when the roofing shingle is installed on a roof (e.g., with other roofing shingles on a roof substrate) and the exposed surfaces correspond to surfaces having direct exposure to the environment when the roofing shingle is installed on the roof (e.g., with other roofing shingles on a roof substrate). In the roofing shingle embodiments, the exposed surfaces and unexposed surfaces of a roofing shingle are described in reference to the roofing system embodiment in which roofing shingles are installed on a roof (e.g., a roof substrate).

As used herein, the term "substantially free of asphalt shingle waste" refers to a coating comprising 5% by weight or less of asphalt shingle waste. The term includes coatings comprising no asphalt shingle waste. In some embodiments, a coating comprises an asphalt shingle waste and an asphalt. In some of these embodiments, the weight percentage of the asphalt shingle waste is based on a total weight of the asphalt shingle waste and the asphalt. In some embodiments in which a coating is substantially free of asphalt shingle waste, the coating may comprise 0.1% to 5% by weight of the asphalt shingle waste based on the total weight of the asphalt shingle waste and the asphalt. In some embodiments, the coating does not comprise the asphalt shingle waste.

As used herein, the term "free of asphalt shingle waste" refers to a coating comprising 1% by weight or less of asphalt shingle waste. The term includes coatings comprising no asphalt shingle waste. In some embodiments, a coating comprises an asphalt shingle waste and an asphalt. In some of these embodiments, the weight percentage of the asphalt shingle waste is based on a total weight of the asphalt shingle waste and the asphalt. In some embodiments in which a coating is free of asphalt shingle waste, the coating may comprise the 0.1% to 1% by weight of asphalt shingle waste based on the total weight of the asphalt shingle waste and the asphalt. In some embodiments, the coating does not comprise the asphalt shingle waste.

As used herein, the term "viscosity" refers to a measure of a fluid's resistance to flow at a given shear rate and temperature. In some embodiments, the viscosity is measured in accordance with ASTM D-4402 by using a Brookfield LVT viscometer at 400° F. with a #31 spindle at 30 RPM.

Some embodiments relate to asphalt shingle waste coatings for roofing systems. In some embodiments, a roofing system comprises, consists of, or consists essentially of at least one of a roof substrate, at least one roofing shingle, or any combinations thereof. In some embodiments, the at least one roofing shingle comprises a plurality of roofing shingles. In some embodiments, the plurality of roofing shingles comprises a first roofing shingle, a second roofing shingle, a third roofing shingle. In some embodiments, the first roofing shingle covers a portion of the second roofing shingle so as to define first unexposed surfaces and first exposed surfaces. In some embodiments, the second roofing shingle covers a portion of the third roofing shingle so as to define second unexposed surfaces and second exposed surfaces. In some embodiments, at least one of the first roofing shingle, the second roofing shingle, the third roofing shingle, or any combination thereof comprises an asphalt shingle waste coating. In some embodiments, the asphalt shingle waste coating is on or is only on at least one of the first unexposed surfaces, at least one of the second unexposed surfaces, or any combination thereof. In some embodiments, at least one of the first roofing shingle, the second roofing shingle, the third roofing shingle, or any combination thereof comprises an asphalt coating. In some embodiments, the asphalt coating is on or is only on at least one of the first exposed surfaces, at least one of the second exposed surfaces, or any combination thereof. In some embodiments, the asphalt coating is free or substantially free of asphalt shingle waste.

Some embodiments relate to asphalt shingle waste coatings on roofing shingles. In some embodiments, a roofing shingle (e.g., a laminated roofing shingle) comprises, consists of, or consists essentially of at least one of a top sheet, a back sheet, an asphalt shingle waste coating, an asphalt coating, or any combination thereof. In some embodiments, the top sheet comprises a headlap and a plurality of tabs extending from a side of the headlap. In some embodiments, the headlap has an unexposed front surface and an unexposed back surface. In some embodiments, the unexposed front surface of the headlap comprises an attachment zone (e.g., a nail zone). In some embodiments, the plurality of tabs has an exposed front surface and an unexposed back surface. In some embodiments, the back sheet is attached to the top sheet. In some embodiments, the back sheet is attached (e.g., laminated) to the top sheet so as to define a common bond area. In some embodiments, the back sheet underlies the plurality of tabs such that at least a portion of the back sheet is visible between the plurality of tabs. In some embodiments, the back sheet has a front surface and a back surface. In some embodiments, the front surface of the back sheet comprises an exposed front surface between the plurality of tabs and an unexposed front surface covered by the plurality of tabs. In some embodiments, the back surface of the back sheet comprises an unexposed back surface.

According to some embodiments, the roofing shingle comprises the asphalt single waste coating on or only on at least one of the unexposed surfaces of the roofing shingle. In some embodiments, the roofing shingle comprises the asphalt shingle waste coating on or only on at least one of the unexposed front surface of the headlap (e.g., which may include the attachment zone), the unexposed back surface of the headlap (e.g., which may include the common bond area), the unexposed back surface of the plurality of tabs, the unexposed front surface of the back sheet, the unexposed back surface of the back sheet, or any combination thereof. In some embodiments, the roofing shingle does not comprise the asphalt shingle waste coating on at least one of the exposed surfaces of the roofing shingle. In some embodiments, the roofing shingle does not comprise the asphalt shingle waste coating on at least one of the exposed front surface of the back sheet, the exposed front surface of the plurality of tabs, or any combination thereof.

According to some embodiments, the roofing shingle comprises the asphalt coating on or only on at least one of the exposed surfaces of the roofing shingle. In some embodiments, the roofing shingle comprises the asphalt coating on or only on at least one of the exposed front surface of the back sheet, the exposed front surface of the plurality of tabs, or any combination thereof. In some embodiments, the roofing shingle comprises the asphalt coating on the entire front surface of the back sheet. In some embodiments, the roofing shingle comprises the asphalt coating on the unexposed front surface of the headlap (e.g., which may include the attachment zone). In some embodiments, the roofing shingle does not comprise the asphalt coating on at least one of the unexposed surfaces of the roofing shingle. In some embodiments, the roofing shingle does not comprise the asphalt coating on at least one of the unexposed front surface of the headlap (e.g., which may include the attachment zone), the unexposed back surface of the headlap (e.g., which may include the common bond area), the unexposed back surface of the plurality of tabs, the unexposed front surface of the back sheet, the unexposed back surface of the back sheet, or any combination thereof.

Some embodiments relate to asphalt shingle waste coatings on roofing shingles. In some embodiments, a roofing shingle (e.g., a strip shingle) comprises, consists of, or consists essentially of a sheet, an asphalt shingle waste coating, an asphalt coating, or any combination thereof. In some embodiments, the sheet consists of a single sheet (e.g., which may be a single-layered sheet, or which may be a multi-layered sheet, such as, for example, a composite layer, among others). In some embodiments, the sheet has a top surface and a back surface. In some embodiments, the top surface comprises the asphalt coating. In some embodiments, the entire top surface comprises the asphalt coating. In some embodiments, the top surface comprises at least one of an exposed surface, an unexposed surface, or any combination thereof. In some embodiments, the back surface comprises the asphalt shingle waste coating. In some embodiments, the entire back surface comprises the asphalt shingle waste coating. In some embodiments, the back surface comprises an unexposed surface.

Some embodiments relate to asphalt shingle waste coatings on roofing shingles. In some embodiments, a roofing shingle comprises, consists of, or consists essentially of at least one of a roof substrate, an asphalt shingle waste coating, an asphalt coating, or any combination thereof. In some embodiments, the roof substrate has a top surface and a bottom surface. In some embodiments, the top surface of the roof substrate comprises the asphalt shingle waste coating. In some embodiments, the entire top surface of the roof substrate comprises the asphalt shingle waste coating. In some embodiments, the bottom surface of the roof substrate comprises the asphalt shingle waste coating. In some embodiments, the entire bottom surface of the roof substrate comprises the asphalt shingle waste coating. In some embodiments, the asphalt coating covers the asphalt shingle waste coating on the top surface of the roof substrate. In some embodiments, the asphalt coating covers the asphalt shingle waste coating on the bottom surface of the roof substrate.

Some embodiments relate to a method for making a roofing shingle. In some embodiments, the method comprises obtaining a substrate. In some embodiments, the substrate has a first surface and a second surface. In some embodiments, the method comprises obtaining an asphalt coating formulation. In some embodiments, the method comprises obtaining an asphalt shingle waste coating formulation. In some embodiments, the method comprises coating the first surface of the substrate with the asphalt coating formulation. In some embodiments, the method comprises coating the second surface of the substrate with the asphalt shingle waste coating formulation. In some embodiments, the method comprises forming a roofing shingle comprising the coated substrate. In some embodiments, the roofing shingle comprises at least one of a laminated shingle, a strip shingle, or any combination thereof.

In some embodiments, the asphalt shingle waste coating comprises, consists of, or consists essentially of at least one of an asphalt shingle waste, an asphalt, at least one filler, or any combination thereof. In some embodiments, the asphalt shingle waste coating comprises, consists of, or consists essentially of a mixture of at least one of the asphalt shingle waste, the asphalt, at least one filler, or any combination thereof.

In some embodiments, the asphalt shingle waste comprises, consists of, or consists essentially of at least one of waste asphalt, limestone, granules, impurities, or any combination thereof. In some embodiments, the impurities comprise, consist of, or consist essentially of at least one of fiberglass mat sand, fines, marker paint, sealant, at least one adhesive, tape, plastic debris, paper debris, soil, woods, nails, or any combination thereof. In some embodiments, the asphalt comprises, consists of, or consists essentially of at least one of virgin asphalt, oxidized asphalt, unoxidized asphalt, polymer-modified asphalt, or any combination thereof. In some embodiments, the polymer-modified asphalt comprises, consists of, or consists essentially of at least one of poly(styrene-butadiene-styrene) (SBS), a poly (styrene-ethylene/butylene-styrene) (SEBS), an atactic polypropylene (APP), an isotactic polypropylene (IPP), or any combination thereof.

In some embodiments, the at least one filler comprises, consists of, or consists essentially of at least one of limestone, glass, calcium carbonate, barium sulfate, calcium sulfate, talc, perlite, silica, fumed silica, precipitated silica, quartz, aluminum trihydrate, magnesium hydroxide, ammonium polyphosphate, colemanite, titanium dioxide, calcium sulfate, fly ash, graphene nanoparticles, carbon black, recycled rubber tires, recycled thermoplastic resins, basalt, roofing granules, graphite, clay, or any combination thereof. In some embodiments in which the at least one filler is present in the asphalt shingle waste coating, the asphalt shingle waste coating may be referred to as an asphalt shingle waste filled coating.

In some embodiments, the asphalt shingle waste coating comprises 30% to 90% by weight of at least one of the asphalt, the asphalt shingle waste, or any combination thereof, based on a total weight of the asphalt shingle waste coating. In some embodiments, the asphalt shingle waste coating comprises 35% to 90% by weight of at least one of the asphalt, the asphalt shingle waste, or any combination thereof, based on the total weight of the asphalt shingle waste coating. In some embodiments, the asphalt shingle waste coating comprises 40% to 90% by weight of at least one of the asphalt, the asphalt shingle waste, or any combination thereof, based on the total weight of the asphalt shingle waste coating. In some embodiments, the asphalt shingle waste coating comprises 45% to 90% by weight of at least one of the asphalt, the asphalt shingle waste, or any combination thereof, based on the total weight of the asphalt shingle waste coating. In some embodiments, the asphalt shingle waste coating comprises 50% to 90% by weight of at least one of the asphalt, the asphalt shingle waste, or any combination thereof, based on the total weight of the asphalt shingle waste coating. In some embodiments, the asphalt shingle waste coating comprises 55% to 90% by weight of at least one of the asphalt, the asphalt shingle waste, or any combination thereof, based on the total weight of the asphalt shingle waste coating. In some embodiments, the asphalt shingle waste coating comprises 60% to 90% by weight of at least one of the asphalt, the asphalt shingle waste, or any combination thereof, based on the total weight of the asphalt shingle waste coating. In some embodiments, the asphalt shingle waste coating comprises 65% to 90% by weight of at least one of the asphalt, the asphalt shingle waste, or any combination thereof, based on the total weight of the asphalt shingle waste coating. In some embodiments, the asphalt shingle waste coating comprises 70% to 90% by weight of at least one of the asphalt, the asphalt shingle waste, or any combination thereof, based on the total weight of the asphalt shingle waste coating. In some embodiments, the asphalt shingle waste coating comprises 75% to 90% by weight of at least one of the asphalt, the asphalt shingle waste, or any combination thereof, based on the total weight of the asphalt shingle waste coating. In some embodiments, the asphalt shingle waste coating comprises 80% to 90% by weight of at least one of the asphalt, the asphalt shingle waste, or any combination thereof, based on the total weight of the asphalt shingle waste coating.

In some embodiments, the asphalt shingle waste coating comprises 30% to 85% by weight of at least one of the asphalt, the asphalt shingle waste, or any combination thereof, based on the total weight of the asphalt shingle waste coating. In some embodiments, the asphalt shingle waste coating comprises 30% to 80% by weight of at least one of the asphalt, the asphalt shingle waste, or any combination thereof, based on the total weight of the asphalt shingle waste coating. In some embodiments, the asphalt shingle waste coating comprises 30% to 75% by weight of at least one of the asphalt, the asphalt shingle waste, or any combination thereof, based on the total weight of the asphalt shingle waste coating. In some embodiments, the asphalt shingle waste coating comprises 30% to 70% by weight of at least one of the asphalt, the asphalt shingle waste, or any combination thereof, based on the total weight of the asphalt shingle waste coating. In some embodiments, the asphalt shingle waste coating comprises 30% to 65% by weight of at least one of the asphalt, the asphalt shingle waste, or any combination thereof, based on the total weight of the asphalt shingle waste coating. In some embodiments, the asphalt shingle waste coating comprises 30% to 60% by weight of at least one of the asphalt, the asphalt shingle waste, or any combination thereof, based on the total weight of the asphalt shingle waste coating. In some embodiments, the asphalt shingle waste coating comprises 30% to 55% by weight of at least one of the asphalt, the asphalt shingle waste, or any combination thereof, based on the total weight of the asphalt shingle waste coating. In some embodiments, the asphalt shingle waste coating comprises 30% to 50% by weight of at least one of the asphalt, the asphalt shingle waste, or any combination thereof, based on the total weight of the asphalt shingle waste coating. In some embodiments, the asphalt shingle waste coating comprises 30% to 45% by weight of at least one of the asphalt, the asphalt shingle waste, or any combination thereof, based on the total weight of the asphalt shingle waste coating. In some embodiments, the asphalt shingle waste coating comprises 30% to 40% by weight of at least one of the asphalt, the asphalt shingle waste, or any combination thereof, based on the total weight of the asphalt shingle waste coating.

In some embodiments, the asphalt shingle waste coating comprises up to 100% by weight of the asphalt shingle waste. For example, in some embodiments, the asphalt shingle waste filled coating comprises an amount of the at least one filler (e.g., 10% to 70% by weight of the at least one filler based on a total weight of the asphalt shingle waste coating, etc.), with a remainder of the asphalt shingle waste filled coating comprising the asphalt shingle waste. In some embodiments, that is, the asphalt shingle waste coating does not comprise asphalt. In some embodiments, the amount of asphalt shingle waste present in the asphalt shingle waste coating is greater than the amount of asphalt shingle waste present in the asphalt coating.

In some embodiments, the asphalt shingle waste coating comprises at least 90% by weight of the asphalt shingle waste based on the total weight of the asphalt shingle waste and the asphalt. In some embodiments, the asphalt shingle waste coating comprises at least 85% by weight of the asphalt shingle waste based on the total weight of the asphalt shingle waste and the asphalt. In some embodiments, the asphalt shingle waste coating comprises at least 80% by weight of the asphalt shingle waste based on the total weight of the asphalt shingle waste and the asphalt. In some embodiments, the asphalt shingle waste coating comprises at least 75% by weight of the asphalt shingle waste based on the total weight of the asphalt shingle waste and the asphalt. In some embodiments, the asphalt shingle waste coating comprises at least 70% by weight of the asphalt shingle waste based on the total weight of the asphalt shingle waste and the asphalt. In some embodiments, the asphalt shingle waste coating comprises at least 65% by weight of the asphalt shingle waste based on the total weight of the asphalt shingle waste and the asphalt. In some embodiments, the asphalt shingle waste coating comprises at least 60% by weight of the asphalt shingle waste based on the total weight of the asphalt shingle waste and the asphalt. In some embodiments, the asphalt shingle waste coating comprises at least 55% by weight of the asphalt shingle waste based on the total weight of the asphalt shingle waste and the asphalt. In some embodiments, the asphalt shingle waste coating comprises at least 50% by weight of the asphalt shingle waste based on the total weight of the asphalt shingle waste and the asphalt. In some embodiments, the asphalt shingle waste coating comprises at least 45% by weight of the asphalt shingle waste based on the total weight of the asphalt shingle waste and the asphalt. In some embodiments, the asphalt shingle waste coating comprises at least 40% by weight of the asphalt shingle waste based on the total weight of the asphalt shingle waste and the asphalt. In some embodiments, the asphalt shingle waste coating comprises at least 35% by weight of the asphalt shingle waste based on the total weight of the asphalt shingle waste and the asphalt. In some embodiments, the asphalt shingle waste coating comprises at least 30% by weight of the asphalt shingle waste based on the total weight of the asphalt shingle waste and the asphalt. In some embodiments, the asphalt shingle waste coating comprises at least 25% by weight of the asphalt shingle waste based on the total weight of the asphalt shingle waste and the asphalt. In some embodiments, the asphalt shingle waste coating comprises at least 20% by weight of the asphalt shingle waste based on the total weight of the asphalt shingle waste and the asphalt. In some embodiments, the asphalt shingle waste coating comprises at least 15% by weight of the asphalt shingle waste based on the total weight of the asphalt shingle waste and the asphalt. In some embodiments, the asphalt shingle waste coating comprises at least 10% by weight of the asphalt shingle waste based on the total weight of the asphalt shingle waste and the asphalt. In some embodiments, the asphalt shingle waste coating comprises at least 5% by weight of the asphalt shingle waste based on the total weight of the asphalt shingle waste and the asphalt.

In some embodiments, the asphalt shingle waste coating comprises 1% to 99% by weight of the asphalt shingle waste based on the total weight of the asphalt shingle waste and the asphalt. In some embodiments, the asphalt shingle waste coating comprises 1% to 95% by weight of the asphalt shingle waste based on the total weight of the asphalt shingle waste and the asphalt. In some embodiments, the asphalt shingle waste coating comprises 1% to 90% by weight of the asphalt shingle waste based on the total weight of the asphalt shingle waste and the asphalt. In some embodiments, the asphalt shingle waste coating comprises 1% to 85% by weight of the asphalt shingle waste based on the total weight of the asphalt shingle waste and the asphalt. In some embodiments, the asphalt shingle waste coating comprises 1% to 80% by weight of the asphalt shingle waste based on the total weight of the asphalt shingle waste and the asphalt. In some embodiments, the asphalt shingle waste coating comprises 1% to 75% by weight of the asphalt shingle waste based on the total weight of the asphalt shingle waste and the asphalt. In some embodiments, the asphalt shingle waste coating comprises 1% to 70% by weight of the asphalt shingle waste based on the total weight of the asphalt shingle waste and the asphalt. In some embodiments, the asphalt shingle waste coating comprises 1% to 65% by weight of the asphalt shingle waste based on the total weight of the asphalt shingle waste and the asphalt. In some embodiments, the asphalt shingle waste coating comprises 1% to 60% by weight of the asphalt shingle waste based on the total weight of the asphalt shingle waste and the asphalt. In some embodiments, the asphalt shingle waste coating comprises 1% to 55% by weight of the asphalt shingle waste based on the total weight of the asphalt shingle waste and the asphalt. In some embodiments, the asphalt shingle waste coating comprises 1% to 50% by weight of the asphalt shingle waste based on the total weight of the asphalt shingle waste and the asphalt. In some embodiments, the asphalt shingle waste coating comprises 1% to 45% by weight of the asphalt shingle waste based on the total weight of the asphalt shingle waste and the asphalt. In some embodiments, the asphalt shingle waste coating comprises 1% to 40% by weight of the asphalt shingle waste based on the total weight of the asphalt shingle waste and the asphalt. In some embodiments, the asphalt shingle waste coating comprises 1% to 35% by weight of the asphalt shingle waste based on the total weight of the asphalt shingle waste and the asphalt. In some embodiments, the asphalt shingle waste coating comprises 1% to 30% by weight of the asphalt shingle waste based on the total weight of the asphalt shingle waste and the asphalt. In some embodiments, the asphalt shingle waste coating comprises 1% to 25% by weight of the asphalt shingle waste based on the total weight of the asphalt shingle waste and the asphalt. In some embodiments, the asphalt shingle waste coating comprises 1% to 20% by weight of the asphalt shingle waste based on the total weight of the asphalt shingle waste and the asphalt.

In some embodiments, the asphalt shingle waste coating comprises 10% to 99% by weight of the asphalt shingle waste based on the total weight of the asphalt shingle waste and the asphalt. In some embodiments, the asphalt shingle waste coating comprises 20% to 90% by weight of the asphalt shingle waste based on the total weight of the asphalt shingle waste and the asphalt. In some embodiments, the asphalt shingle waste coating comprises 20% to 80% by weight of the asphalt shingle waste based on the total weight of the asphalt shingle waste and the asphalt. In some embodiments, the asphalt shingle waste coating comprises 20% to 70% by weight of the asphalt shingle waste based on the total weight of the asphalt shingle waste and the asphalt. In some embodiments, the asphalt shingle waste coating comprises 20% to 60% by weight of the asphalt shingle waste based on the total weight of the asphalt shingle waste and the asphalt. In some embodiments, the asphalt shingle waste coating comprises 30% to 99% by weight of the asphalt shingle waste based on the total weight of the asphalt shingle waste and the asphalt. In some embodiments, the asphalt shingle waste coating comprises 30% to 90% by weight of the asphalt shingle waste based on the total weight of the asphalt shingle waste and the asphalt. In some embodiments, the asphalt shingle waste coating comprises 30% to 80% by weight of the asphalt shingle waste based on the total weight of the asphalt shingle waste and the asphalt. In some embodiments, the asphalt shingle waste coating comprises 30% to 70% by weight of the asphalt shingle waste based on the total weight of the asphalt shingle waste and the asphalt. In some embodiments, the asphalt shingle waste coating comprises 30% to 60% by weight of the asphalt shingle waste based on the total weight of the asphalt shingle waste and the asphalt. In some embodiments, the asphalt shingle waste coating comprises 40% to 99% by weight of the asphalt shingle waste based on the total weight of the asphalt shingle waste and the asphalt. In some embodiments, the asphalt shingle waste coating comprises 40% to 90% by weight of the asphalt shingle waste based on the total weight of the asphalt shingle waste and the asphalt. In some embodiments, the asphalt shingle waste coating comprises 40% to 80% by weight of the asphalt shingle waste based on the total weight of the asphalt shingle waste and the asphalt. In some embodiments, the asphalt shingle waste coating comprises 40% to 70% by weight of the asphalt shingle waste based on the total weight of the asphalt shingle waste and the asphalt. In some embodiments, the asphalt shingle waste coating comprises 40% to 60% by weight of the asphalt shingle waste based on the total weight of the asphalt shingle waste and the asphalt. In some embodiments, the asphalt shingle waste coating comprises 50% to 99% by weight of the asphalt shingle waste based on the total weight of the asphalt shingle waste and the asphalt. In some embodiments, the asphalt shingle waste coating comprises 50% to 90% by weight of the asphalt shingle waste based on the total weight of the asphalt shingle waste and the asphalt. In some embodiments, the asphalt shingle waste coating comprises 50% to 80% by weight of the asphalt shingle waste based on the total weight of the asphalt shingle waste and the asphalt. In some embodiments, the asphalt shingle waste coating comprises 50% to 70% by weight of the asphalt shingle waste based on the total weight of the asphalt shingle waste and the asphalt.

In some embodiments, the asphalt shingle waste coating comprises 0.1% to 99% by weight of the asphalt based on the total weight of the asphalt shingle waste and the asphalt. In some embodiments, the asphalt shingle waste coating comprises 1% to 99% by weight of the asphalt based on the total weight of the asphalt shingle waste and the asphalt. In some embodiments, the asphalt shingle waste coating comprises 5% to 99% by weight of the asphalt based on the total weight of the asphalt shingle waste and the asphalt. In some embodiments, the asphalt shingle waste coating comprises 10% to 99% by weight of the asphalt based on the total weight of the asphalt shingle waste and the asphalt. In some embodiments, the asphalt shingle waste coating comprises 15% to 99% by weight of the asphalt based on the total weight of the asphalt shingle waste and the asphalt. In some embodiments, the asphalt shingle waste coating comprises 20% to 99% by weight of the asphalt based on the total weight of the asphalt shingle waste and the asphalt. In some embodiments, the asphalt shingle waste coating comprises 25% to 99% by weight of the asphalt based on the total weight of the asphalt shingle waste and the asphalt. In some embodiments, the asphalt shingle waste coating comprises 30% to 99% by weight of the asphalt based on the total weight of the asphalt shingle waste and the asphalt. In some embodiments, the asphalt shingle waste coating comprises 35% to 99% by weight of the asphalt based on the total weight of the asphalt shingle waste and the asphalt. In some embodiments, the asphalt shingle waste coating comprises 40% to 99% by weight of the asphalt based on the total weight of the asphalt shingle waste and the asphalt. In some embodiments, the asphalt shingle waste coating comprises 45% to 99% by weight of the asphalt based on the total weight of the asphalt shingle waste and the asphalt. In some embodiments, the asphalt shingle waste coating comprises 50% to 99% by weight of the asphalt based on the total weight of the asphalt shingle waste and the asphalt. In some embodiments, the asphalt shingle waste coating comprises 55% to 99% by weight of the asphalt based on the total weight of the asphalt shingle waste and the asphalt. In some embodiments, the asphalt shingle waste coating comprises 60% to 99% by weight of the asphalt based on the total weight of the asphalt shingle waste and the asphalt. In some embodiments, the asphalt shingle waste coating comprises 65% to 99% by weight of the asphalt based on the total weight of the asphalt shingle waste and the asphalt. In some embodiments, the asphalt shingle waste coating comprises 70% to 99% by weight of the asphalt based on the total weight of the asphalt shingle waste and the asphalt. In some embodiments, the asphalt shingle waste coating comprises 75% to 99% by weight of the asphalt based on the total weight of the asphalt shingle waste and the asphalt. In some embodiments, the asphalt shingle waste coating comprises 80% to 99% by weight of the asphalt based on the total weight of the asphalt shingle waste and the asphalt. In some embodiments, the asphalt shingle waste coating comprises 85% to 99% by weight of the asphalt based on the total weight of the asphalt shingle waste and the asphalt. In some embodiments, the asphalt shingle waste coating comprises 90% to 99% by weight of the asphalt based on the total weight of the asphalt shingle waste and the asphalt.

In some embodiments, the asphalt shingle waste coating comprises 0.1% to 95% by weight of the asphalt based on the total weight of the asphalt shingle waste and the asphalt. In some embodiments, the asphalt shingle waste coating comprises 0.1% to 90% by weight of the asphalt based on the total weight of the asphalt shingle waste and the asphalt. In some embodiments, the asphalt shingle waste coating comprises 0.1% to 85% by weight of the asphalt based on the total weight of the asphalt shingle waste and the asphalt. In some embodiments, the asphalt shingle waste coating comprises 0.1% to 80% by weight of the asphalt based on the total weight of the asphalt shingle waste and the asphalt. In some embodiments, the asphalt shingle waste coating comprises 0.1% to 75% by weight of the asphalt based on the total weight of the asphalt shingle waste and the asphalt. In some embodiments, the asphalt shingle waste coating comprises 0.1% to 70% by weight of the asphalt based on the total weight of the asphalt shingle waste and the asphalt. In some embodiments, the asphalt shingle waste coating comprises 0.1% to 65% by weight of the asphalt based on the total weight of the asphalt shingle waste and the asphalt. In some embodiments, the asphalt shingle waste coating comprises 0.1% to 60% by weight of the asphalt based on the total weight of the asphalt shingle waste and the asphalt. In some embodiments, the asphalt shingle waste coating comprises 0.1% to 55% by weight of the asphalt based on the total weight of the asphalt shingle waste and the asphalt. In some embodiments, the asphalt shingle waste coating comprises 0.1% to 50% by weight of the asphalt based on the total weight of the asphalt shingle waste and the asphalt. In some embodiments, the asphalt shingle waste coating comprises 0.1% to 45% by weight of the asphalt based on the total weight of the asphalt shingle waste and the asphalt. In some embodiments, the asphalt shingle waste coating comprises 0.1% to 40% by weight of the asphalt based on the total weight of the asphalt shingle waste and the asphalt. In some embodiments, the asphalt shingle waste coating comprises 0.1% to 35% by weight of the asphalt based on the total weight of the asphalt shingle waste and the asphalt. In some embodiments, the asphalt shingle waste coating comprises 0.1% to 30% by weight of the asphalt based on the total weight of the asphalt shingle waste and the asphalt. In some embodiments, the asphalt shingle waste coating comprises 0.1% to 25% by weight of the asphalt based on the total weight of the asphalt shingle waste and the asphalt. In some embodiments, the asphalt shingle waste coating comprises 0.1% to 20% by weight of the asphalt based on the total weight of the asphalt shingle waste and the asphalt. In some embodiments, the asphalt shingle waste coating comprises 0.1% to 15% by weight of the asphalt based on the total weight of the asphalt shingle waste and the asphalt. In some embodiments, the asphalt shingle waste coating comprises 0.1% to 10% by weight of the asphalt based on the total weight of the asphalt shingle waste and the asphalt.

In some embodiments, the asphalt shingle waste coating comprises 10% to 70% by weight of the at least one filler based on a total weight of the asphalt shingle waste coating. In some embodiments, the asphalt shingle waste coating comprises 10% to 65% by weight of the at least one filler based on the total weight of the asphalt shingle waste coating. In some embodiments, the asphalt shingle waste coating comprises 10% to 60% by weight of the at least one filler based on the total weight of the asphalt shingle waste coating. In some embodiments, the asphalt shingle waste coating comprises 10% to 55% by weight of the at least one filler based on the total weight of the asphalt shingle waste coating. In some embodiments, the asphalt shingle waste coating comprises 10% to 50% by weight of the at least one filler based on the total weight of the asphalt shingle waste coating. In some embodiments, the asphalt shingle waste coating comprises 10% to 45% by weight of the at least one filler based on the total weight of the asphalt shingle waste coating. In some embodiments, the asphalt shingle waste coating comprises 10% to 40% by weight of the at least one filler based on the total weight of the asphalt shingle waste coating. In some embodiments, the asphalt shingle waste coating comprises 10% to 35% by weight of the at least one filler based on the total weight of the asphalt shingle waste coating. In some embodiments, the asphalt shingle waste coating comprises 10% to 30% by weight of the at least one filler based on the total weight of the asphalt shingle waste coating. In some embodiments, the asphalt shingle waste coating comprises 10% to 25% by weight of the at least one filler based on the total weight of the asphalt shingle waste coating. In some embodiments, the asphalt shingle waste coating comprises 10% to 20% by weight of the at least one filler based on the total weight of the asphalt shingle waste coating. In some embodiments, the asphalt shingle waste coating comprises 10% to 15% by weight of the at least one filler based on the total weight of the asphalt shingle waste coating.

In some embodiments, the asphalt shingle waste coating comprises 15% to 70% by weight of the at least one filler based on the total weight of the asphalt shingle waste coating. In some embodiments, the asphalt shingle waste coating comprises 20% to 70% by weight of the at least one filler based on the total weight of the asphalt shingle waste coating. In some embodiments, the asphalt shingle waste coating comprises 25% to 70% by weight of the at least one filler based on the total weight of the asphalt shingle waste coating. In some embodiments, the asphalt shingle waste coating comprises 30% to 70% by weight of the at least one filler based on the total weight of the asphalt shingle waste coating. In some embodiments, the asphalt shingle waste coating comprises 35% to 70% by weight of the at least one filler based on the total weight of the asphalt shingle waste coating. In some embodiments, the asphalt shingle waste coating comprises 40% to 70% by weight of the at least one filler based on the total weight of the asphalt shingle waste coating. In some embodiments, the asphalt shingle waste coating comprises 45% to 70% by weight of the at least one filler based on the total weight of the asphalt shingle waste coating. In some embodiments, the asphalt shingle waste coating comprises 50% to 70% by weight of the at least one filler based on the total weight of the asphalt shingle waste coating. In some embodiments, the asphalt shingle waste coating comprises 55% to 70% by weight of the at least one filler based on the total weight of the asphalt shingle waste coating. In some embodiments, the asphalt shingle waste coating comprises 60% to 70% by weight of the at least one filler based on the total weight of the asphalt shingle waste coating. In some embodiments, the asphalt shingle waste coating comprises 65% to 70% by weight of the at least one filler based on the total weight of the asphalt shingle waste coating.

In some embodiments, the asphalt shingle waste coating further comprises a viscosity modifier.

In some embodiments, the viscosity modifier comprises at least one of a polymer, a pine chemical additive, a renewable oil, or any combination thereof. In some embodiments, the polymer comprises at least one of hydroxylethyl cellulose (HEC), polyacrylamide, an (anionic) acrylamide copolymer, or any combination thereof. In some embodiments, the pine chemical additive can be derived from Crude Tall Oil, which is a renewable raw material and a by-product of the paper industry. In some embodiments, the pine chemical additive comprises at least one of octadecadienoic acid, octadecenoic acid, or any combination thereof. In some embodiments, the renewable oil comprises at least one of hexadecanoic acid, hexadecanoic acid ethyl ester, octadecadienoic acid, octadecadienoic acid ethyl ester, octadecenoic acid, ethyl oleate, sitosterol, or any combination thereof. In some embodiments, the viscosity modifier comprises at least one of hexadecanoic acid, octadecadienoic acid, octadecenoic acid, octadecanoic acid, tocopherol, campesterol, stigmasterol, sitosterol, or any combination thereof.

In some embodiments, the asphalt shingle waste coating comprises 1% to 10% by weight of the viscosity modifier based on the total weight of the asphalt shingle waste coating. In some embodiments, the asphalt shingle waste coating comprises 1% to 9% by weight of the viscosity modifier based on the total weight of the asphalt shingle waste coating. In some embodiments, the asphalt shingle waste coating comprises 1% to 8% by weight of the viscosity modifier based on the total weight of the asphalt shingle waste coating. In some embodiments, the asphalt shingle waste coating comprises 1% to 7% by weight of the viscosity modifier based on the total weight of the asphalt shingle waste coating. In some embodiments, the asphalt shingle waste coating comprises 1% to 6% by weight of the viscosity modifier based on the total weight of the asphalt shingle waste coating. In some embodiments, the asphalt shingle waste coating comprises 1% to 5% by weight of the viscosity modifier based on the total weight of the asphalt shingle waste coating. In some embodiments, the asphalt shingle waste coating comprises 1% to 4% by weight of the viscosity modifier based on the total weight of the asphalt shingle waste coating. In some embodiments, the asphalt shingle waste coating comprises 1% to 3% by weight of the viscosity modifier based on the total weight of the asphalt shingle waste coating.

In some embodiments, the asphalt shingle waste coating comprises 2% to 10% by weight of the viscosity modifier based on the total weight of the asphalt shingle waste coating. In some embodiments, the asphalt shingle waste coating comprises 3% to 10% by weight of the viscosity modifier based on the total weight of the asphalt shingle waste coating. In some embodiments, the asphalt shingle waste coating comprises 4% to 10% by weight of the viscosity modifier based on the total weight of the asphalt shingle waste coating. In some embodiments, the asphalt shingle waste coating comprises 5% to 10% by weight of the viscosity modifier based on the total weight of the asphalt shingle waste coating. In some embodiments, the asphalt shingle waste coating comprises 6% to 10% by weight of the viscosity modifier based on the total weight of the asphalt shingle waste coating. In some embodiments, the asphalt shingle waste coating comprises 7% to 10% by weight of the viscosity modifier based on the total weight of the asphalt shingle waste coating. In some embodiments, the asphalt shingle waste coating comprises 8% to 10% by weight of the viscosity modifier based on the total weight of the asphalt shingle waste coating.

In some embodiments, the asphalt shingle waste coating comprises 2% to 8% by weight of the viscosity modifier based on the total weight of the asphalt shingle waste coating. In some embodiments, the asphalt shingle waste coating comprises 2% to 7% by weight of the viscosity modifier based on the total weight of the asphalt shingle waste coating. In some embodiments, the asphalt shingle waste coating comprises 2% to 6% by weight of the viscosity modifier based on the total weight of the asphalt shingle waste coating. In some embodiments, the asphalt shingle waste coating comprises 2% to 5% by weight of the viscosity modifier based on the total weight of the asphalt shingle waste coating. In some embodiments, the asphalt shingle waste coating comprises 2% to 4% by weight of the viscosity modifier based on the total weight of the asphalt shingle waste coating. In some embodiments, the asphalt shingle waste coating comprises 3% to 8% by weight of the viscosity modifier based on the total weight of the asphalt shingle waste coating. In some embodiments, the asphalt shingle waste coating comprises 4% to 8% by weight of the viscosity modifier based on the total weight of the asphalt shingle waste coating. In some embodiments, the asphalt shingle waste coating comprises 5% to 8% by weight of the viscosity modifier based on the total weight of the asphalt shingle waste coating. In some embodiments, the asphalt shingle waste coating comprises 6% to 8% by weight of the viscosity modifier based on the total weight of the asphalt shingle waste coating.

In some embodiments, the asphalt shingle waste coating has a viscosity of 200 cP to 20,000 cP. In some embodiments, the asphalt shingle waste coating has a viscosity of 500 cP to 20,000 cP. In some embodiments, the asphalt shingle waste coating has a viscosity of 1,000 cP to 20,000 cP. In some embodiments, the asphalt shingle waste coating has a viscosity of 5,000 cP to 20,000 cP. In some embodiments, the asphalt shingle waste coating has a viscosity of 10,000 cP to 20,000 cP. In some embodiments, the asphalt shingle waste coating has a viscosity of 15,000 cP to 20,000 cP. In some embodiments, the asphalt shingle waste coating has a viscosity of 200 cP to 15,000 cP. In some embodiments, the asphalt shingle waste coating has a viscosity of 200 cP to 10,000 cP. In some embodiments, the asphalt shingle waste coating has a viscosity of 200 cP to 5,000 cP. In some embodiments, the asphalt shingle waste coating has a viscosity of 200 cP to 1,000 cP. In some embodiments, the asphalt shingle waste coating has a viscosity of 200 cP to 500 cP. In some embodiments, the asphalt shingle waste coating has a viscosity of 500 cP to 15,000 cP. In some embodiments, the asphalt shingle waste coating has a viscosity of 1,000 cP to 10,000 cP.

In some embodiments, the asphalt coating comprises, consists of, or consists essentially of at least one of an asphalt shingle waste, an asphalt, at least one filler, or any combination thereof. In some embodiments, the asphalt coating comprises, consists of, or consists essentially of a mixture of at least one of the asphalt shingle waste, the asphalt, at least one filler, or any combination thereof.

In some embodiments, the asphalt shingle waste comprises, consists of, or consists essentially of at least one of waste asphalt, limestone, granules, impurities, or any combination thereof. In some embodiments, the impurities comprise, consist of, or consist essentially of at least one of fiberglass mat sand, fines, marker paint, sealant, at least one adhesive, tape, plastic debris, paper debris, soil, woods, nails, or any combination thereof. In some embodiments, the asphalt comprises, consists of, or consists essentially of at least one of virgin asphalt, oxidized asphalt, unoxidized asphalt, polymer-modified asphalt, or any combination thereof. In some embodiments, the polymer-modified asphalt comprises, consists of, or consists essentially of at least one of poly(styrene-butadiene-styrene) (SBS), a poly (styrene-ethylene/butylene-styrene) (SEBS), an atactic polypropylene (APP), an isotactic polypropylene (IPP), or any combination thereof.

In some embodiments, the at least one filler comprises, consists of, or consists essentially of at least one of limestone, glass, calcium carbonate, barium sulfate, calcium sulfate, talc, perlite, silica, fumed silica, precipitated silica, quartz, aluminum trihydrate, magnesium hydroxide, ammonium polyphosphate, colemanite, titanium dioxide, calcium sulfate, fly ash, graphene nanoparticles, carbon black, recycled rubber tires, recycled thermoplastic resins, basalt, roofing granules, graphite, clay, or any combination thereof.

In some embodiments, the asphalt coating comprises 30% to 90% by weight of at least one of the asphalt, the asphalt shingle waste, or any combination thereof, based on a total weight of the asphalt coating. In some embodiments, the asphalt coating comprises 35% to 90% by weight of at least one of the asphalt, the asphalt shingle waste, or any combination thereof, based on the total weight of the asphalt coating. In some embodiments, the asphalt coating comprises 40% to 90% by weight of at least one of the asphalt, the asphalt shingle waste, or any combination thereof, based on the total weight of the asphalt coating. In some embodiments, the asphalt coating comprises 45% to 90% by weight of at least one of the asphalt, the asphalt shingle waste, or any combination thereof, based on the total weight of the asphalt coating. In some embodiments, the asphalt coating comprises 50% to 90% by weight of at least one of the asphalt, the asphalt shingle waste, or any combination thereof, based on the total weight of the asphalt coating. In some embodiments, the asphalt coating comprises 55% to 90% by weight of at least one of the asphalt, the asphalt shingle waste, or any combination thereof, based on the total weight of the asphalt coating. In some embodiments, the asphalt coating comprises 60% to 90% by weight of at least one of the asphalt, the asphalt shingle waste, or any combination thereof, based on the total weight of the asphalt coating. In some embodiments, the asphalt coating comprises 65% to 90% by weight of at least one of the asphalt, the asphalt shingle waste, or any combination thereof, based on the total weight of the asphalt coating. In some embodiments, the asphalt coating comprises 70% to 90% by weight of at least one of the asphalt, the asphalt shingle waste, or any combination thereof, based on the total weight of the asphalt coating. In some embodiments, the asphalt coating comprises 75% to 90% by weight of at least one of the asphalt, the asphalt shingle waste, or any combination thereof, based on the total weight of the asphalt coating. In some embodiments, the asphalt coating comprises 80% to 90% by weight of at least one of the asphalt, the asphalt shingle waste, or any combination thereof, based on the total weight of the asphalt coating.

In some embodiments, the asphalt coating comprises 30% to 85% by weight of at least one of the asphalt, the asphalt shingle waste, or any combination thereof, based on the total weight of the asphalt coating. In some embodiments, the asphalt coating comprises 30% to 80% by weight of at least one of the asphalt, the asphalt shingle waste, or any combination thereof, based on the total weight of the asphalt coating. In some embodiments, the asphalt coating comprises 30% to 75% by weight of at least one of the asphalt, the asphalt shingle waste, or any combination thereof, based on the total weight of the asphalt coating. In some embodiments, the asphalt coating comprises 30% to 70% by weight of at least one of the asphalt, the asphalt shingle waste, or any combination thereof, based on the total weight of the asphalt coating. In some embodiments, the asphalt coating comprises 30% to 65% by weight of at least one of the asphalt, the asphalt shingle waste, or any combination thereof, based on the total weight of the asphalt coating. In some embodiments, the asphalt coating comprises 30% to 60% by weight of at least one of the asphalt, the asphalt shingle waste, or any combination thereof, based on the total weight of the asphalt coating. In some embodiments, the asphalt coating comprises 30% to 55% by weight of at least one of the asphalt, the asphalt shingle waste, or any combination thereof, based on the total weight of the asphalt coating. In some embodiments, the asphalt coating comprises 30% to 50% by weight of at least one of the asphalt, the asphalt shingle waste, or any combination thereof, based on the total weight of the asphalt coating. In some embodiments, the asphalt coating comprises 30% to 45% by weight of at least one of the asphalt, the asphalt shingle waste, or any combination thereof, based on the total weight of the asphalt coating. In some embodiments, the asphalt coating comprises 30% to 40% by weight of at least one of the asphalt, the asphalt shingle waste, or any combination thereof, based on the total weight of the asphalt coating.

In some embodiments, the asphalt coating comprises 0.1% to 99% by weight of asphalt shingle waste based on a total weight of the asphalt shingle waste and the asphalt. In some embodiments, the asphalt coating comprises 0.1% to 95% by weight of asphalt shingle waste based on the total weight of the asphalt shingle waste and the asphalt. In some embodiments, the asphalt coating comprises 0.1% to 90% by weight of asphalt shingle waste based on the total weight of the asphalt shingle waste and the asphalt. In some embodiments, the asphalt coating comprises 0.1% to 85% by weight of asphalt shingle waste based on the total weight of the asphalt shingle waste and the asphalt. In some embodiments, the asphalt coating comprises 0.1% to 80% by weight of asphalt shingle waste based on the total weight of the asphalt shingle waste and the asphalt. In some embodiments, the asphalt coating comprises 0.1% to 75% by weight of asphalt shingle waste based on the total weight of the asphalt shingle waste and the asphalt. In some embodiments, the asphalt coating comprises 0.1% to 70% by weight of asphalt shingle waste based on the total weight of the asphalt shingle waste and the asphalt. In some embodiments, the asphalt coating comprises 0.1% to 65% by weight of asphalt shingle waste based on the total weight of the asphalt shingle waste and the asphalt. In some embodiments, the asphalt coating comprises 0.1% to 60% by weight of asphalt shingle waste based on the total weight of the asphalt shingle waste and the asphalt. In some embodiments, the asphalt coating comprises 0.1% to 55% by weight of asphalt shingle waste based on the total weight of the asphalt shingle waste and the asphalt. In some embodiments, the asphalt coating comprises 0.1% to 50% by weight of asphalt shingle waste based on the total weight of the asphalt shingle waste and the asphalt. In some embodiments, the asphalt coating comprises 0.1% to 45% by weight of asphalt shingle waste based on the total weight of the asphalt shingle waste and the asphalt. In some embodiments, the asphalt coating comprises 0.1% to 40% by weight of asphalt shingle waste based on the total weight of the asphalt shingle waste and the asphalt. In some embodiments, the asphalt coating comprises 0.1% to 35% by weight of asphalt shingle waste based on the total weight of the asphalt shingle waste and the asphalt. In some embodiments, the asphalt coating comprises 0.1% to 30% by weight of asphalt shingle waste based on the total weight of the asphalt shingle waste and the asphalt. In some embodiments, the asphalt coating comprises 0.1% to 25% by weight of asphalt shingle waste based on the total weight of the asphalt shingle waste and the asphalt. In some embodiments, the asphalt coating comprises 0.1% to 20% by weight of asphalt shingle waste based on the total weight of the asphalt shingle waste and the asphalt. In some embodiments, the asphalt coating comprises 0.1% to 15% by weight of asphalt shingle waste based on the total weight of the asphalt shingle waste and the asphalt. In some embodiments, the asphalt coating comprises 0.1% to 10% by weight of asphalt shingle waste based on the total weight of the asphalt shingle waste and the asphalt.

In some embodiments, the asphalt coating comprises 5% to 99% by weight of asphalt shingle waste based on the total weight of the asphalt shingle waste and the asphalt. In some embodiments, the asphalt coating comprises 10% to 99% by weight of asphalt shingle waste based on the total weight of the asphalt shingle waste and the asphalt. In some embodiments, the asphalt coating comprises 15% to 99% by weight of asphalt shingle waste based on the total weight of the asphalt shingle waste and the asphalt. In some embodiments, the asphalt coating comprises 20% to 99% by weight of asphalt shingle waste based on the total weight of the asphalt shingle waste and the asphalt. In some embodiments, the asphalt coating comprises 25% to 99% by weight of asphalt shingle waste based on the total weight of the asphalt shingle waste and the asphalt. In some embodiments, the asphalt coating comprises 30% to 99% by weight of asphalt shingle waste based on the total weight of the asphalt shingle waste and the asphalt. In some embodiments, the asphalt coating comprises 35% to 99% by weight of asphalt shingle waste based on the total weight of the asphalt shingle waste and the asphalt. In some embodiments, the asphalt coating comprises 40% to 99% by weight of asphalt shingle waste based on the total weight of the asphalt shingle waste and the asphalt. In some embodiments, the asphalt coating comprises 45% to 99% by weight of asphalt shingle waste based on the total weight of the asphalt shingle waste and the asphalt. In some embodiments, the asphalt coating comprises 50% to 99% by weight of asphalt shingle waste based on the total weight of the asphalt shingle waste and the asphalt. In some embodiments, the asphalt coating comprises 55% to 99% by weight of asphalt shingle waste based on the total weight of the asphalt shingle waste and the asphalt. In some embodiments, the asphalt coating comprises 60% to 99% by weight of asphalt shingle waste based on the total weight of the asphalt shingle waste and the asphalt. In some embodiments, the asphalt coating comprises 65% to 99% by weight of asphalt shingle waste based on the total weight of the asphalt shingle waste and the asphalt. In some embodiments, the asphalt coating comprises 70% to 99% by weight of asphalt shingle waste based on the total weight of the asphalt shingle waste and the asphalt. In some embodiments, the asphalt coating comprises 75% to 99% by weight of asphalt shingle waste based on the total weight of the asphalt shingle waste and the asphalt. In some embodiments, the asphalt coating comprises 80% to 99% by weight of asphalt shingle waste based on the total weight of the asphalt shingle waste and the asphalt. In some embodiments, the asphalt coating comprises 85% to 99% by weight of asphalt shingle waste based on the total weight of the asphalt shingle waste and the asphalt. In some embodiments, the asphalt coating comprises 90% to 99% by weight of asphalt shingle waste based on the total weight of the asphalt shingle waste and the asphalt.

In some embodiments, the asphalt coating comprises up to 100% by weight of the asphalt. For example, in some embodiments, the asphalt coating comprises an amount of the at least one filler (e.g., 10% to 70% by weight of the at least one filler based on a total weight of the asphalt coating, etc.), with a remainder of the asphalt coating comprising the asphalt. In some embodiments, that is, the asphalt coating does not comprise asphalt shingle waste. In some embodiments, the amount of asphalt present in the asphalt coating is greater than the amount of asphalt present in the asphalt shingle waste coating.

In some embodiments, the asphalt coating is substantially free of the asphalt shingle waste. For example, in some embodiments, the asphalt coating comprises 5% by weight of asphalt shingle waste or less based on the total weight of the asphalt shingle waste and the asphalt. In some embodiments, the asphalt coating comprises 4.5% by weight of asphalt shingle waste or less based on the total weight of the asphalt shingle waste and the asphalt. In some embodiments, the asphalt coating comprises 4% by weight of asphalt shingle waste or less based on the total weight of the asphalt shingle waste and the asphalt. In some embodiments, the asphalt coating comprises 3.5% by weight of asphalt shingle waste or less based on the total weight of the asphalt shingle waste and the asphalt. In some embodiments, the asphalt coating comprises 3% by weight of asphalt shingle waste or less based on the total weight of the asphalt shingle waste and the asphalt. In some embodiments, the asphalt coating comprises 2.5% by weight of asphalt shingle waste or less based on the total weight of the asphalt shingle waste and the asphalt. In some embodiments, the asphalt coating comprises 2% by weight of asphalt shingle waste or less based on the total weight of the asphalt shingle waste and the asphalt. In some embodiments, the asphalt coating comprises 1.5% by weight of asphalt shingle waste or less based on the total weight of the asphalt shingle waste and the asphalt. In some embodiments, the asphalt coating comprises 1% by weight of asphalt shingle waste or less based on the total weight of the asphalt shingle waste and the asphalt. In some embodiments, the asphalt coating comprises 0.5% by weight of asphalt shingle waste or less based on the total weight of the asphalt shingle waste and the asphalt.

In some embodiments, the asphalt coating comprises 0.1% to 5% by weight of asphalt shingle waste or less based on the total weight of the asphalt shingle waste and the asphalt. In some embodiments, the asphalt coating comprises 0.1% to 4.5% by weight of asphalt shingle waste or less based on the total weight of the asphalt shingle waste and the asphalt. In some embodiments, the asphalt coating comprises 0.1% to 4% by weight of asphalt shingle waste or less based on the total weight of the asphalt shingle waste and the asphalt. In some embodiments, the asphalt coating comprises 0.1% to 3.5% by weight of asphalt shingle waste or less based on the total weight of the asphalt shingle waste and the asphalt. In some embodiments, the asphalt coating comprises 0.1% to 3% by weight of asphalt shingle waste or less based on the total weight of the asphalt shingle waste and the asphalt. In some embodiments, the asphalt coating comprises 0.1% to 2.5% by weight of asphalt shingle waste or less based on the total weight of the asphalt shingle waste and the asphalt. In some embodiments, the asphalt coating comprises 0.1% to 2% by weight of asphalt shingle waste or less based on the total weight of the asphalt shingle waste and the asphalt. In some embodiments, the asphalt coating comprises 0.1% to 1.5% by weight of asphalt shingle waste or less based on the total weight of the asphalt shingle waste and the asphalt. In some embodiments, the asphalt coating comprises 0.1% to 1% by weight of asphalt shingle waste or less based on the total weight of the asphalt shingle waste and the asphalt. In some embodiments, the asphalt coating comprises 0.1% to 0.5% by weight of asphalt shingle waste or less based on the total weight of the asphalt shingle waste and the asphalt.

In some embodiments, the asphalt coating comprises 0.5% to 5% by weight of asphalt shingle waste or less based on the total weight of the asphalt shingle waste and the asphalt. In some embodiments, the asphalt coating comprises 1% to 5% by weight of asphalt shingle waste or less based on the total weight of the asphalt shingle waste and the asphalt. In some embodiments, the asphalt coating comprises 1.5% to 5% by weight of asphalt shingle waste or less based on the total weight of the asphalt shingle waste and the asphalt. In some embodiments, the asphalt coating comprises 2% to 5% by weight of asphalt shingle waste or less based on the total weight of the asphalt shingle waste and the asphalt. In some embodiments, the asphalt coating comprises 2.5% to 5% by weight of asphalt shingle waste or less based on the total weight of the asphalt shingle waste and the asphalt. In some embodiments, the asphalt coating comprises 3% to 5% by weight of asphalt shingle waste or less based on the total weight of the asphalt shingle waste and the asphalt. In some embodiments, the asphalt coating comprises 3.5% to 5% by weight of asphalt shingle waste or less based on the total weight of the asphalt shingle waste and the asphalt. In some embodiments, the asphalt coating comprises 4% to 5% by weight of asphalt shingle waste or less based on the total weight of the asphalt shingle waste and the asphalt. In some embodiments, the asphalt coating comprises 4.5% to 5% by weight of asphalt shingle waste or less based on the total weight of the asphalt shingle waste and the asphalt.

In some embodiments, the asphalt coating is free of the asphalt shingle waste. For example, in some embodiments, the asphalt coating comprises 1% by weight of asphalt shingle waste or less based on the total weight of the asphalt shingle waste and the asphalt. In some embodiments, the asphalt coating comprises 0.9% by weight of asphalt shingle waste or less based on the total weight of the asphalt shingle waste and the asphalt. In some embodiments, the asphalt coating comprises 0.8% by weight of asphalt shingle waste or less based on the total weight of the asphalt shingle waste and the asphalt. In some embodiments, the asphalt coating comprises 0.7% by weight of asphalt shingle waste or less based on the total weight of the asphalt shingle waste and the asphalt. In some embodiments, the asphalt coating comprises 0.6% by weight of asphalt shingle waste or less based on the total weight of the asphalt shingle waste and the asphalt. In some embodiments, the asphalt coating comprises 0.5% by weight of asphalt shingle waste or less based on the total weight of the asphalt shingle waste and the asphalt. In some embodiments, the asphalt coating comprises 0.4% by weight of asphalt shingle waste or less based on the total weight of the asphalt shingle waste and the asphalt. In some embodiments, the asphalt coating comprises 0.3% by weight of asphalt shingle waste or less based on the total weight of the asphalt shingle waste and the asphalt. In some embodiments, the asphalt coating comprises 0.2% by weight of asphalt shingle waste or less based on the total weight of the asphalt shingle waste and the asphalt. In some embodiments, the asphalt coating comprises 0.1% by weight of asphalt shingle waste or less based on the total weight of the asphalt shingle waste and the asphalt.

In some embodiments, the asphalt coating comprises 0.1% to 0.9% by weight of asphalt shingle waste based on the total weight of the asphalt shingle waste and the asphalt. In some embodiments, the asphalt coating comprises 0.1% to 0.8% by weight of asphalt shingle waste based on the total weight of the asphalt shingle waste and the asphalt. In some embodiments, the asphalt coating comprises 0.1% to 0.7% by weight of asphalt shingle waste based on the total weight of the asphalt shingle waste and the asphalt. In some embodiments, the asphalt coating comprises 0.1% to 0.6% by weight of asphalt shingle waste based on the total weight of the asphalt shingle waste and the asphalt. In some embodiments, the asphalt coating comprises 0.1% to 0.5% by weight of asphalt shingle waste based on the total weight of the asphalt shingle waste and the asphalt. In some embodiments, the asphalt coating comprises 0.1% to 0.4% by weight of asphalt shingle waste based on the total weight of the asphalt shingle waste and the asphalt. In some embodiments, the asphalt coating comprises 0.1% to 0.3% by weight of asphalt shingle waste based on the total weight of the asphalt shingle waste and the asphalt. In some embodiments, the asphalt coating comprises 0.1% to 0.2% by weight of asphalt shingle waste based on the total weight of the asphalt shingle waste and the asphalt.

In some embodiments, the asphalt coating comprises 0.2% to 1% by weight of asphalt shingle waste based on the total weight of the asphalt shingle waste and the asphalt. In some embodiments, the asphalt coating comprises 0.3% to 1% by weight of asphalt shingle waste based on the total weight of the asphalt shingle waste and the asphalt. In some embodiments, the asphalt coating comprises 0.4% to 1% by weight of asphalt shingle waste based on the total weight of the asphalt shingle waste and the asphalt. In some embodiments, the asphalt coating comprises 0.5% to 1% by weight of asphalt shingle waste based on the total weight of the asphalt shingle waste and the asphalt. In some embodiments, the asphalt coating comprises 0.6% to 1% by weight of asphalt shingle waste based on the total weight of the asphalt shingle waste and the asphalt. In some embodiments, the asphalt coating comprises 0.7% to 1% by weight of asphalt shingle waste based on the total weight of the asphalt shingle waste and the asphalt. In some embodiments, the asphalt coating comprises 0.8% to 1% by weight of asphalt shingle waste based on the total weight of the asphalt shingle waste and the asphalt. In some embodiments, the asphalt coating comprises 0.9% to 1% by weight of asphalt shingle waste based on the total weight of the asphalt shingle waste and the asphalt.

In some embodiments, the asphalt coating comprises 1% to 99% by weight of asphalt based on the total weight of the asphalt shingle waste and the asphalt. In some embodiments, the asphalt coating comprises 1% to 95% by weight of asphalt based on the total weight of the asphalt shingle waste and the asphalt. In some embodiments, the asphalt coating comprises 1% to 90% by weight of asphalt based on the total weight of the asphalt shingle waste and the asphalt. In some embodiments, the asphalt coating comprises 1% to 85% by weight of asphalt based on the total weight of the asphalt shingle waste and the asphalt. In some embodiments, the asphalt coating comprises 1% to 80% by weight of asphalt based on the total weight of the asphalt shingle waste and the asphalt. In some embodiments, the asphalt coating comprises 1% to 75% by weight of asphalt based on the total weight of the asphalt shingle waste and the asphalt. In some embodiments, the asphalt coating comprises 1% to 70% by weight of asphalt based on the total weight of the asphalt shingle waste and the asphalt. In some embodiments, the asphalt coating comprises 1% to 65% by weight of asphalt based on the total weight of the asphalt shingle waste and the asphalt. In some embodiments, the asphalt coating comprises 1% to 60% by weight of asphalt based on the total weight of the asphalt shingle waste and the asphalt. In some embodiments, the asphalt coating comprises 1% to 55% by weight of asphalt based on the total weight of the asphalt shingle waste and the asphalt. In some embodiments, the asphalt coating comprises 1% to 50% by weight of asphalt based on the total weight of the asphalt shingle waste and the asphalt. In some embodiments, the asphalt coating comprises 1% to 45% by weight of asphalt based on the total weight of the asphalt shingle waste and the asphalt. In some embodiments, the asphalt coating comprises 1% to 40% by weight of asphalt based on the total weight of the asphalt shingle waste and the asphalt. In some embodiments, the asphalt coating comprises 1% to 35% by weight of asphalt based on the total weight of the asphalt shingle waste and the asphalt. In some embodiments, the asphalt coating comprises 1% to 30% by weight of asphalt based on the total weight of the asphalt shingle waste and the asphalt. In some embodiments, the asphalt coating comprises 1% to 25% by weight of asphalt based on the total weight of the asphalt shingle waste and the asphalt. In some embodiments, the asphalt coating comprises 1% to 20% by weight of asphalt based on the total weight of the asphalt shingle waste and the asphalt. In some embodiments, the asphalt coating comprises 1% to 15% by weight of asphalt based on the total weight of the asphalt shingle waste and the asphalt. In some embodiments, the asphalt coating comprises 1% to 10% by weight of asphalt based on the total weight of the asphalt shingle waste and the asphalt.

In some embodiments, the asphalt coating comprises 5% to 99% by weight of asphalt based on the total weight of the asphalt shingle waste and the asphalt. In some embodiments, the asphalt coating comprises 10% to 99% by weight of asphalt based on the total weight of the asphalt shingle waste and the asphalt. In some embodiments, the asphalt coating comprises 15% to 99% by weight of asphalt based on the total weight of the asphalt shingle waste and the asphalt. In some embodiments, the asphalt coating comprises 20% to 99% by weight of asphalt based on the total weight of the asphalt shingle waste and the asphalt. In some embodiments, the asphalt coating comprises 25% to 99% by weight of asphalt based on the total weight of the asphalt shingle waste and the asphalt. In some embodiments, the asphalt coating comprises 30% to 99% by weight of asphalt based on the total weight of the asphalt shingle waste and the asphalt. In some embodiments, the asphalt coating comprises 35% to 99% by weight of asphalt based on the total weight of the asphalt shingle waste and the asphalt. In some embodiments, the asphalt coating comprises 40% to 99% by weight of asphalt based on the total weight of the asphalt shingle waste and the asphalt. In some embodiments, the asphalt coating comprises 45% to 99% by weight of asphalt based on the total weight of the asphalt shingle waste and the asphalt. In some embodiments, the asphalt coating comprises 50% to 99% by weight of asphalt based on the total weight of the asphalt shingle waste and the asphalt. In some embodiments, the asphalt coating comprises 55% to 99% by weight of asphalt based on the total weight of the asphalt shingle waste and the asphalt. In some embodiments, the asphalt coating comprises 60% to 99% by weight of asphalt based on the total weight of the asphalt shingle waste and the asphalt. In some embodiments, the asphalt coating comprises 65% to 99% by weight of asphalt based on the total weight of the asphalt shingle waste and the asphalt. In some embodiments, the asphalt coating comprises 70% to 99% by weight of asphalt based on the total weight of the asphalt shingle waste and the asphalt. In some embodiments, the asphalt coating comprises 75% to 99% by weight of asphalt based on the total weight of the asphalt shingle waste and the asphalt. In some embodiments, the asphalt coating comprises 80% to 99% by weight of asphalt based on the total weight of the asphalt shingle waste and the asphalt. In some embodiments, the asphalt coating comprises 85% to 99% by weight of asphalt based on the total weight of the asphalt shingle waste and the asphalt. In some embodiments, the asphalt coating comprises 90% to 99% by weight of asphalt based on the total weight of the asphalt shingle waste and the asphalt.

In some embodiments, the asphalt coating comprises 10% to 70% by weight of the at least one filler based on a total weight of the asphalt coating. In some embodiments, the asphalt coating comprises 10% to 65% by weight of the at least one filler based on the total weight of the asphalt coating. In some embodiments, the asphalt coating comprises 10% to 60% by weight of the at least one filler based on the total weight of the asphalt coating. In some embodiments, the asphalt coating comprises 10% to 55% by weight of the at least one filler based on the total weight of the asphalt coating. In some embodiments, the asphalt coating comprises 10% to 50% by weight of the at least one filler based on the total weight of the asphalt coating. In some embodiments, the asphalt coating comprises 10% to 45% by weight of the at least one filler based on the total weight of the asphalt coating. In some embodiments, the asphalt coating comprises 10% to 40% by weight of the at least one filler based on the total weight of the asphalt coating. In some embodiments, the asphalt coating comprises 10% to 35% by weight of the at least one filler based on the total weight of the asphalt coating. In some embodiments, the asphalt coating comprises 10% to 30% by weight of the at least one filler based on the total weight of the asphalt coating. In some embodiments, the asphalt coating comprises 10% to 25% by weight of the at least one filler based on the total weight of the asphalt coating. In some embodiments, the asphalt coating comprises 10% to 20% by weight of the at least one filler based on the total weight of the asphalt coating. In some embodiments, the asphalt coating comprises 10% to 15% by weight of the at least one filler based on the total weight of the asphalt coating.

In some embodiments, the asphalt coating comprises 15% to 70% by weight of the at least one filler based on the total weight of the asphalt coating. In some embodiments, the asphalt coating comprises 20% to 70% by weight of the at least one filler based on the total weight of the asphalt coating. In some embodiments, the asphalt coating comprises 25% to 70% by weight of the at least one filler based on the total weight of the asphalt coating. In some embodiments, the asphalt coating comprises 30% to 70% by weight of the at least one filler based on the total weight of the asphalt coating. In some embodiments, the asphalt coating comprises 35% to 70% by weight of the at least one filler based on the total weight of the asphalt coating. In some embodiments, the asphalt coating comprises 40% to 70% by weight of the at least one filler based on the total weight of the asphalt coating. In some embodiments, the asphalt coating comprises 45% to 70% by weight of the at least one filler based on the total weight of the asphalt coating. In some embodiments, the asphalt coating comprises 50% to 70% by weight of the at least one filler based on the total weight of the asphalt coating. In some embodiments, the asphalt coating comprises 55% to 70% by weight of the at least one filler based on the total weight of the asphalt coating. In some embodiments, the asphalt coating comprises 60% to 70% by weight of the at least one filler based on the total weight of the asphalt coating. In some embodiments, the asphalt coating comprises 65% to 70% by weight of the at least one filler based on the total weight of the asphalt coating.

FIG. 1 is a schematic diagram of a perspective view of a roofing shingle 100, according to some embodiments. In some embodiments, the roofing shingle 100 may be a laminated roofing shingle. Any of the asphalt shingle waste coatings and asphalt coatings of this disclosure may be used herein.

As shown in FIG. 1, in some embodiments, the roofing shingle 100 comprises, consists of, or consists essentially of at least one of a top sheet 102, a back sheet 104, or any combination thereof. In some embodiments, the top sheet 102 comprises a headlap 110 and a plurality of tabs 112 extending from a side of the headlap 110. In some embodiments, the headlap 110 has an unexposed front surface 114 and an unexposed back surface 116. In some embodiments, the unexposed front surface 114 comprises an attachment zone 140 (e.g., a nail zone). In some embodiments, the plurality of tabs 112 comprises at least one of a first tab 118, a second tab 120, a third tab 122, a fourth tab 124, or any combination thereof. In some embodiments, the plurality of tabs 112 further comprises a fifth tab (not shown). In some embodiments, the plurality of tabs 112 has an exposed front surface 126 and an unexposed back surface 128.

In some embodiments, the back sheet 104 underlies the plurality of tabs 112 such that the back sheet 104 comprises a front surface and an unexposed back surface 130. In some embodiments, the front surface comprises an exposed front surface 132 between the plurality of tabs 112. In some embodiments, the front surface comprises an unexposed front surface 134 covered by the plurality of tabs 112. In some embodiments, a portion of the front surface comprises an unexposed front surface 136 which overlaps with a portion of the unexposed back surface 128 of the top sheet 102. In some embodiments, these overlapping surfaces of the back sheet 104 and the top sheet 102 define a common bond area 138. In some embodiments, the back sheet 104 is attached to the top sheet 102 in, for example, the common bond area 138 via at least one of a plurality of mechanical fasteners, an adhesive or adhesive strips, or any combination thereof. In some embodiments, the back sheet 104 is laminated to the top sheet 102.

Figure 2:
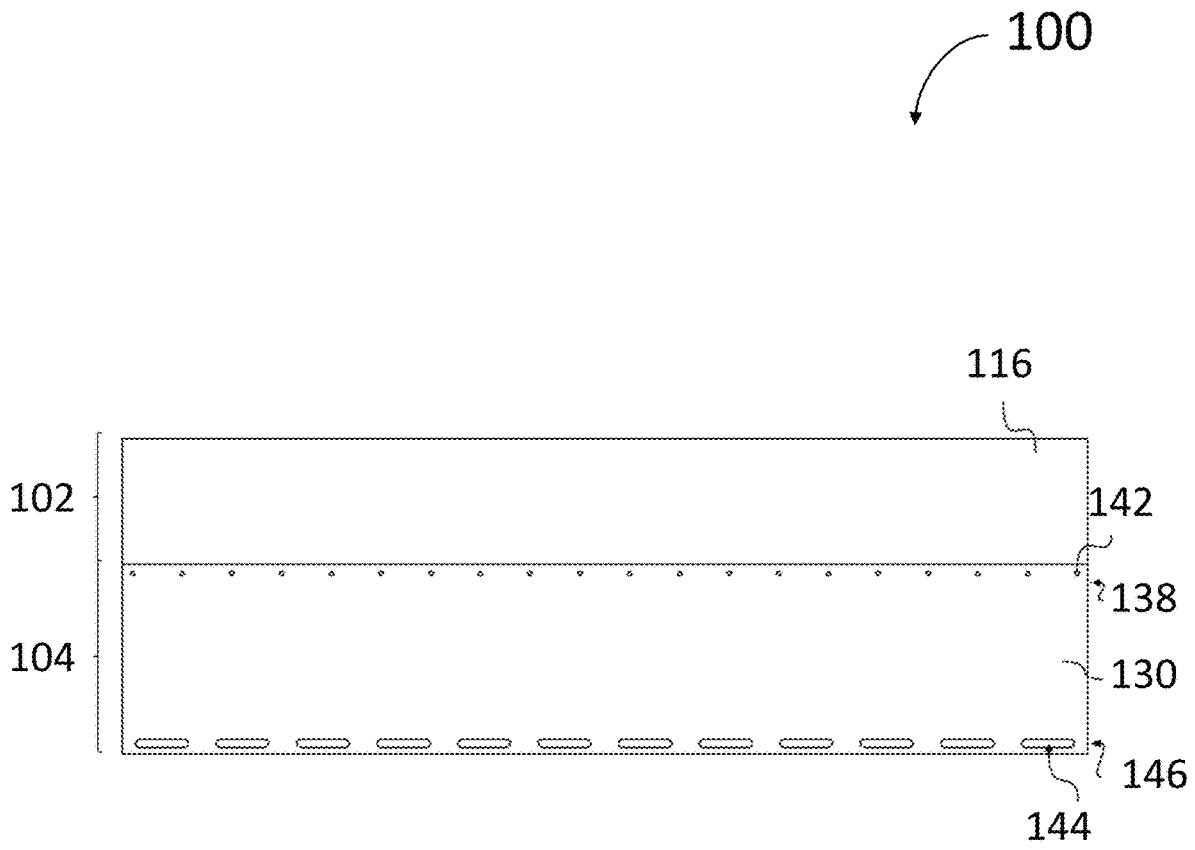
FIG. 2 is a schematic diagram of a backside of the roofing shingle shown in FIG. 1, according to some embodiments.

FIG. 2 is a schematic diagram of a backside of the roofing shingle 100, according to some embodiments. Any of the asphalt shingle waste coatings and asphalt coatings of this disclosure may be used herein.

As shown in FIG. 2, in some embodiments, the backside of the roofing shingle 100 comprises the unexposed back surface 116 of the top sheet 102 and the unexposed back surface 130 of the back sheet 104. In some embodiments, the back sheet 104 is attached to the unexposed back surface 116 of the top sheet 102 in the common bond area 138 via a plurality of mechanical fasteners 142. In some embodiments, the unexposed back surface 116 of the back sheet 104 comprises a line of sealant 144 along a lower edge 146 of the back sheet 104. In some embodiments, the line of sealant 144 is configured to attach the roofing shingle 100 to the attachment zone 140 of a previously installed roofing material (not shown). Although the roofing material of FIG. 2 is shown with a line of sealant 144 comprising a plurality of spaced apart segments of sealant, it will be appreciated that other configurations of the sealant may be employed without departing from the scope of this disclosure. For example, in some embodiments, the sealant is at least one of a single line of sealant, multiple lines of sealant, or any combination thereof.

With continued reference to FIGS. 1 and 2, in some embodiments, the roofing shingle 100 further comprises an asphalt shingle waste coating on or only on at least one of the unexposed surfaces. For example, in some embodiments, the asphalt shingle waste coating is disposed on at least one of the unexposed front surface 114 of the headlap 110, the unexposed back surface 116 of the headlap 110, the unexposed back surface 128 of the plurality of tabs 112, the unexposed back surface 130 of the back sheet 104, the unexposed front surface 134 of the back sheet 104, the unexposed front surface 136 of the back sheet 104, the common bond area 138, the attachment zone 140, or any combination thereof. In some embodiments, the asphalt shingle waste coating is disposed only on at least one of the unexposed front surface 114 of the headlap 110, the unexposed back surface 116 of the headlap 110, the unexposed back surface 128 of the plurality of tabs 112, the unexposed back surface 130 of the back sheet 104, the unexposed front surface 134 of the back sheet 104, the unexposed front surface 136 of the back sheet 104, the common bond area 138, the attachment zone 140, or any combination thereof. In some embodiments, the asphalt shingle waste coating is not disposed on any exposed surface.

In some embodiments, the unexposed front surface 114 of the headlap 110 comprises, consists of, or consists essentially of the asphalt shingle waste coating. In some embodiments, the unexposed back surface 116 of the headlap 110 comprises, consists of, or consists essentially of the asphalt shingle waste coating. In some embodiments, the unexposed back surface 128 of the plurality of tabs 112 comprises, consists of, or consists essentially of the asphalt shingle waste coating. In some embodiments, the unexposed back surface 130 of the back sheet 104 comprises, consists of, or consists essentially of the asphalt shingle waste coating. In some embodiments, the unexposed front surface 134 of the back sheet 104 comprises, consists of, or consists essentially of the asphalt shingle waste coating. In some embodiments, the unexposed front surface 136 of the back sheet 104 comprises, consists of, or consists essentially of the asphalt shingle waste coating. In some embodiments, the common bond area 138 comprises, consists of, or consists essentially of the asphalt shingle waste coating. In some embodiments, the attachment zone 140 comprises, consists of, or consists essentially of the asphalt shingle waste coating. In some embodiments, the asphalt shingle waste coating is not disposed on at least one of the unexposed surfaces.

In some embodiments, the roofing shingle 100 further comprises an asphalt coating. In some embodiments, the asphalt coating is not disposed on unexposed surfaces of the roofing shingle 100. For example, in some embodiments, the asphalt coating is not disposed on at least one of the unexposed front surface 114 of the headlap 110, the unexposed back surface 116 of the headlap 110, the unexposed back surface 128 of the plurality of tabs 112, the unexposed back surface 130 of the back sheet 104, the unexposed front surface 134 of the back sheet 104, the unexposed front surface 136 of the back sheet 104, the common bond area 138, the attachment zone 140, or any combination thereof. In some embodiments, the unexposed front surface 114 of the headlap 110 does not comprise the asphalt coating. In some embodiments, the unexposed back surface 116 of the headlap 110 does not comprise the asphalt coating. In some embodiments, the unexposed back surface 128 of the plurality of tabs 112 does not comprise the asphalt coating. In some embodiments, the unexposed back surface 130 of the back sheet 104 does not comprise the asphalt coating. In some embodiments, the unexposed front surface 134 of the back sheet 104 does not comprise the asphalt coating. In some embodiments, the unexposed front surface 136 of the back sheet 104 does not comprise the asphalt coating. In some embodiments, the common bond area 138 does not comprise the asphalt coating. In some embodiments, the attachment zone 140 does not comprise the asphalt coating.

In some embodiments, the asphalt coating is disposed on or only on at least one of the exposed surfaces, at least one of the unexposed surfaces, or any combination thereof. For example, in some embodiments, the asphalt coating is disposed on at least one of the exposed front surface 126 of the plurality of tabs 112, the exposed front surface of the back sheet 104, or any combination thereof. In some embodiments, the asphalt coating is disposed only on at least one of the exposed front surface 126 of the plurality of tabs 112, the exposed front surface of the back sheet 104, or any combination thereof. In some embodiments, the asphalt coating is disposed on at least one of the unexposed front surface 114 of the headlap 110, the front surface of the back sheet 104 (e.g., at least one of the exposed front surface 132 of the back sheet, the unexposed front surface 134 of the back sheet 104, or any combination thereof), or any combination thereof. In some embodiments, the exposed front surface 126 of the plurality of tabs 112 comprises, consists of, or consists essentially of the asphalt coating. In some embodiments, the exposed front surface of the back sheet 104 comprises, consists of, or consists essentially of the asphalt coating.

Figure 3:
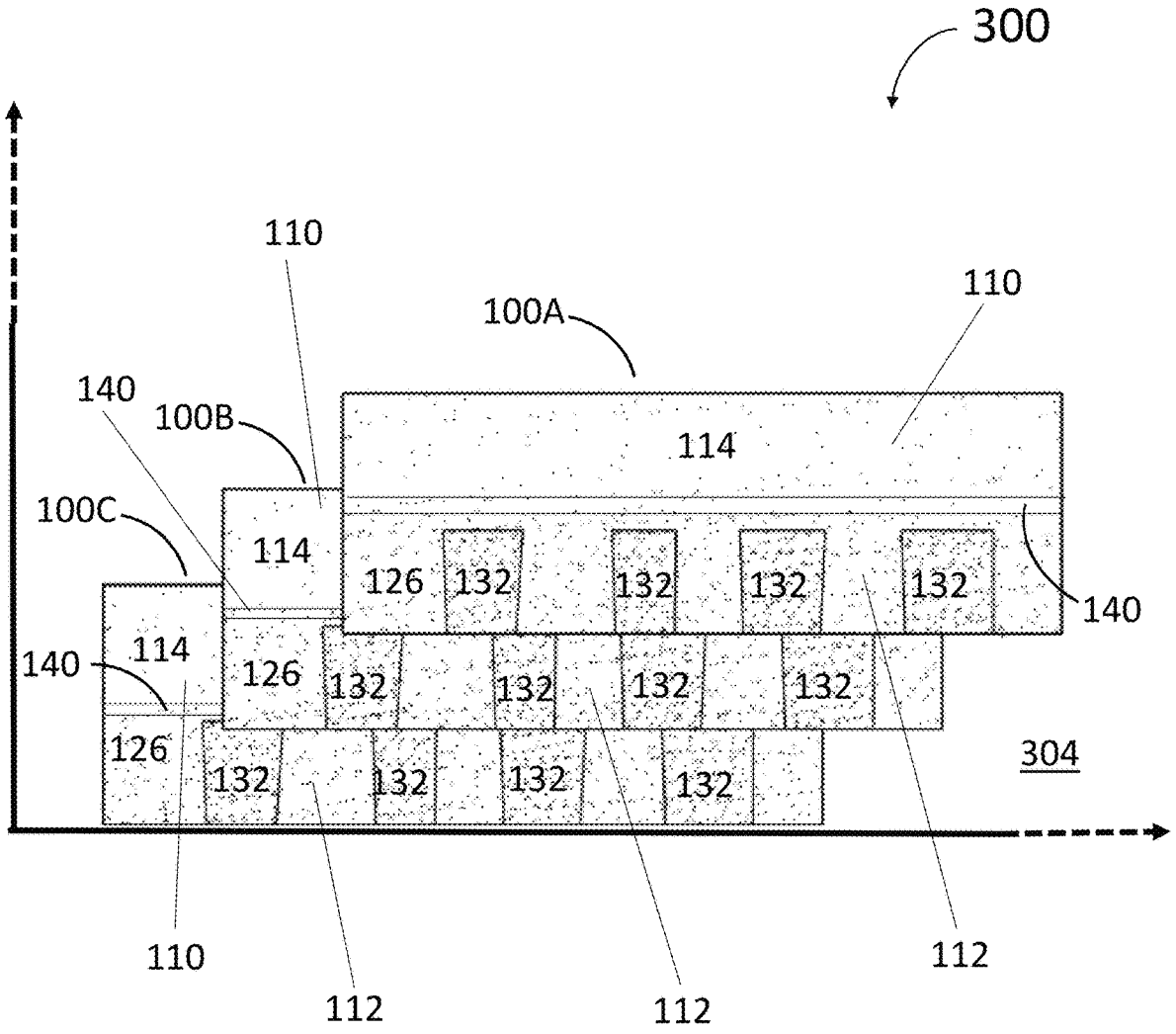
FIG. 3 is a schematic diagram of a portion of a roofing system, according to some embodiments.

FIG. 3 is a schematic diagram of a portion of a roofing system 300, according to some embodiments. Any of the asphalt shingle waste coatings and asphalt coatings of this disclosure may be used herein.

As shown in FIG. 3, in some embodiments, the portion of the roofing system 300 comprises a plurality of roofing shingles on a roof substrate 304. In some embodiments, the roof substrate 304 comprises at least one of a roof deck, an underlayment, or any combination thereof. In some embodiments, the plurality of roofing shingles comprises a plurality of the roofing shingle 100 discussed above with respect to FIGS. 1 and 2. For example, in some embodiments, the plurality of roofing shingles comprises at least three of the roofing shingle 100, each labeled as 100A, 100B, and 100C for simplicity. That is, in some embodiments, the plurality of roofing shingles comprises at least a first roofing shingle 100A, a second roofing shingle 100B, and a third roofing shingle 100C. Not all reference numbers for the roofing shingle 100 are shown in FIG. 3 for simplicity. Although the portion of the roofing system 300 comprises three roofing shingles, it will be appreciated that more than three roofing shingles may be used (e.g., depending on the size (e.g., surface area or dimensions) of a roof substrate, the size (e.g., surface area or dimensions of the roofing shingle(s)), or any combination thereof), without departing from the scope of this disclosure.

In some embodiments, the first roofing shingle 100A covers a portion of the second roofing shingle 100B so as to define first unexposed surfaces and first exposed surfaces. In some embodiments, the second roofing shingle 100B covers a portion of the third roofing shingle 100C so as to define second unexposed surfaces and second exposed surfaces. The manner in which the roofing shingles are attached is not particularly limited. For example, in some embodiments, the line of sealant 144 on the unexposed back surface 130 of the back sheet 104 of the first roofing shingle 100A is attached to the attachment zone 140 of the second roofing shingle 100B, which is previously installed (e.g., installed before the first roofing shingle 100A). In some embodiments, a line of sealant 144 on the unexposed back surface 130 of the back sheet 104 of the second roofing shingle 100B is attached to the attachment zone 140 of the third roofing shingle 100C, which is previously installed (e.g., installed before the first roofing shingle 100A and the second roofing shingle 100B). It will be appreciated that other techniques for attaching the roofing shingles may be used herein without departing from this disclosure.

In some embodiments, each of the first roofing shingle 100A, the second roofing shingle 100B, and the third roofing shingle 100C independently comprises an asphalt shingle waste coating on at least one of the first unexposed surfaces, at least one of the second unexposed surfaces, or any combination thereof.

In some embodiments, the first unexposed surfaces and the second unexposed surfaces comprise at least one of the following: the unexposed front surface 114 of the headlap 110 of the first roofing shingle 100A, the unexposed back surface 116 of the headlap 110 of the first roofing shingle 100A, the unexposed front surface 114 of the headlap 110 of the second roofing shingle 100B, the unexposed back surface 116 of the headlap 110 of the second roofing shingle 100B, the unexposed front surface 114 of the headlap 110 of the third roofing shingle 100C, the unexposed back surface 116 of the headlap 110 of the third roofing shingle 100C, the unexposed back surface 128 of the plurality of tabs 112 of the first roofing shingle 100A, the unexposed back surface 128 of the plurality of tabs 112 of the second roofing shingle 100B, the unexposed back surface 128 of the plurality of tabs 112 of the third roofing shingle 100C, the unexposed front surface 134 of the back sheet 104 of the first roofing shingle 100A, the unexposed front surface 134 of the back sheet 104 of the second roofing shingle 100B, the unexposed front surface 134 of the back sheet 104 of the third roofing shingle 100C, the unexposed back surface 130 of the back sheet 104 of the first roofing shingle 100A, the unexposed back surface 130 of the back sheet 104 of the second roofing shingle 100B, the unexposed back surface 130 of the back sheet 104 of the third roofing shingle 100C, or any combination thereof.

In some embodiments, the first roofing shingle 100A, the second roofing shingle 100B, and the third roofing shingle 100C comprise an asphalt shingle waste coating on or only on at least one of the following first unexposed surfaces and second unexposed surfaces: the unexposed front surface 114 of the headlap 110 of the first roofing shingle 100A, the unexposed back surface 116 of the headlap 110 of the first roofing shingle 100A, the unexposed front surface 114 of the headlap 110 of the second roofing shingle 100B, the unexposed back surface 116 of the headlap 110 of the second roofing shingle 100B, the unexposed front surface 114 of the headlap 110 of the third roofing shingle 100C, the unexposed back surface 116 of the headlap 110 of the third roofing shingle 100C, the unexposed back surface 128 of the plurality of tabs 112 of the first roofing shingle 100A, the unexposed back surface 128 of the plurality of tabs 112 of the second roofing shingle 100B, the unexposed back surface 128 of the plurality of tabs 112 of the third roofing shingle 100C, the unexposed front surface 134 of the back sheet 104 of the first roofing shingle 100A, the unexposed front surface 134 of the back sheet 104 of the second roofing shingle 100B, the unexposed front surface 134 of the back sheet 104 of the third roofing shingle 100C, the unexposed back surface 130 of the back sheet 104 of the first roofing shingle 100A, the unexposed back surface 130 of the back sheet 104 of the second roofing shingle 100B, the unexposed back surface 130 of the back sheet 104 of the third roofing shingle 100C, or any combination thereof.

In some embodiments, the asphalt shingle waste coating is disposed on or only on the unexposed front surface 114 of the headlap 110 of the first roofing shingle 100A. In some embodiments, the asphalt shingle waste coating is disposed on or only on the unexposed back surface 116 of the headlap 110 of the first roofing shingle 100A. In some embodiments, the asphalt shingle waste coating is disposed on or only on the unexposed front surface 114 of the headlap 110 of the second roofing shingle 100B. In some embodiments, the asphalt shingle waste coating is disposed on or only on the unexposed back surface 116 of the headlap 110 of the second roofing shingle 100B. In some embodiments, the asphalt shingle waste coating is disposed on or only on the unexposed front surface 114 of the headlap 110 of the third roofing shingle 100C. In some embodiments, the asphalt shingle waste coating is disposed on or only on the unexposed back surface 116 of the headlap 110 of the third roofing shingle 100C. In some embodiments, the asphalt shingle waste coating is disposed on or only on the unexposed back surface 128 of the plurality of tabs 112 of the first roofing shingle 100A. In some embodiments, the asphalt shingle waste coating is disposed on or only on the unexposed back surface 128 of the plurality of tabs 112 of the second roofing shingle 100B. In some embodiments, the asphalt shingle waste coating is disposed on or only on the unexposed back surface 128 of the plurality of tabs 112 of the third roofing shingle 100C. In some embodiments, the asphalt shingle waste coating is disposed on or only on the unexposed front surface 134 of the back sheet 104 of the first roofing shingle 100A. In some embodiments, the asphalt shingle waste coating is disposed on or only on the unexposed front surface 134 of the back sheet 104 of the second roofing shingle 100B. In some embodiments, the asphalt shingle waste coating is disposed on or only on the unexposed front surface 134 of the back sheet 104 of the third roofing shingle 100C. In some embodiments, the asphalt shingle waste coating is disposed on or only on the unexposed back surface 130 of the back sheet 104 of the first roofing shingle 100A. In some embodiments, the asphalt shingle waste coating is disposed on or only on the unexposed back surface 130 of the back sheet 104 of the second roofing shingle 100B. In some embodiments, the asphalt shingle waste coating is disposed on or only on the unexposed back surface 130 of the back sheet 104 of the third roofing shingle 100C.

In some embodiments, the asphalt shingle waste coating is not disposed on at least one unexposed surface. For example, in some embodiments, at least one of the first unexposed surfaces, at least one of the second unexposed surfaces, or any combination thereof does not comprise the asphalt shingle waste coating. In some embodiments, the asphalt shingle waste coating is not disposed on any exposed surface. For example, in some embodiments, at least one of the first exposed surfaces, the second exposed surfaces, or any combination thereof does not comprise the asphalt shingle waste coating.

In some embodiments, the first exposed surfaces and the second exposed surfaces comprise at least one of the following: the exposed front surface 126 of the plurality of tabs 112 of the first roofing shingle 100A, the exposed front surface 132 of the back sheet 104 of the first roofing shingle 100A, the exposed front surface 126 of the plurality of tabs 112 of the second roofing shingle 100B, the exposed front surface 132 of the back sheet 104 of the second roofing shingle 100B, the exposed front surface 126 of the plurality of tabs 112 of the third roofing shingle 100C, the exposed front surface 132 of the back sheet 104 of the third roofing shingle 100C, or any combination thereof.

In some embodiments, the first roofing shingle 100A, the second roofing shingle 100B, and the third roofing shingle 100C comprise an asphalt coating on or only on at least one of the following first exposed surfaces and second exposed surfaces: the exposed front surface 126 of the plurality of tabs 112 of the first roofing shingle 100A, the exposed front surface 132 of the back sheet 104 of the first roofing shingle 100A, the exposed front surface 126 of the plurality of tabs 112 of the second roofing shingle 100B, the exposed front surface 132 of the back sheet 104 of the second roofing shingle 100B, the exposed front surface 126 of the plurality of tabs 112 of the third roofing shingle 100C, the exposed front surface 132 of the back sheet 104 of the third roofing shingle 100C, or any combination thereof.

In some embodiments, the asphalt coating is disposed on or only on the exposed front surface 126 of the plurality of tabs 112 of the first roofing shingle 100A. In some embodiments, the asphalt coating is disposed on or only on the exposed front surface 132 of the back sheet 104 of the first roofing shingle 100A. In some embodiments, the asphalt coating is disposed on or only on the exposed front surface 126 of the plurality of tabs 112 of the second roofing shingle 100B. In some embodiments, the asphalt coating is disposed on or only on the exposed front surface 132 of the back sheet 104 of the second roofing shingle 100B. In some embodiments, the asphalt coating is disposed on or only on the exposed front surface 126 of the plurality of tabs 112 of the third roofing shingle 100C. In some embodiments, the asphalt coating is disposed on or only on the exposed front surface 132 of the back sheet 104 of the third roofing shingle 100C.

In some embodiments, the asphalt coating is not disposed on at least one of the exposed surfaces. For example, in some embodiments, the asphalt coating is not disposed on at least one of the first exposed surfaces, at least one of the second exposed surfaces, or any combination thereof. In some embodiments, the asphalt coating is not disposed on any unexposed surface. In some embodiments, the asphalt coating is not disposed on at least one of the first unexposed surfaces, the second unexposed surfaces, or any combination thereof.

Figure 4:
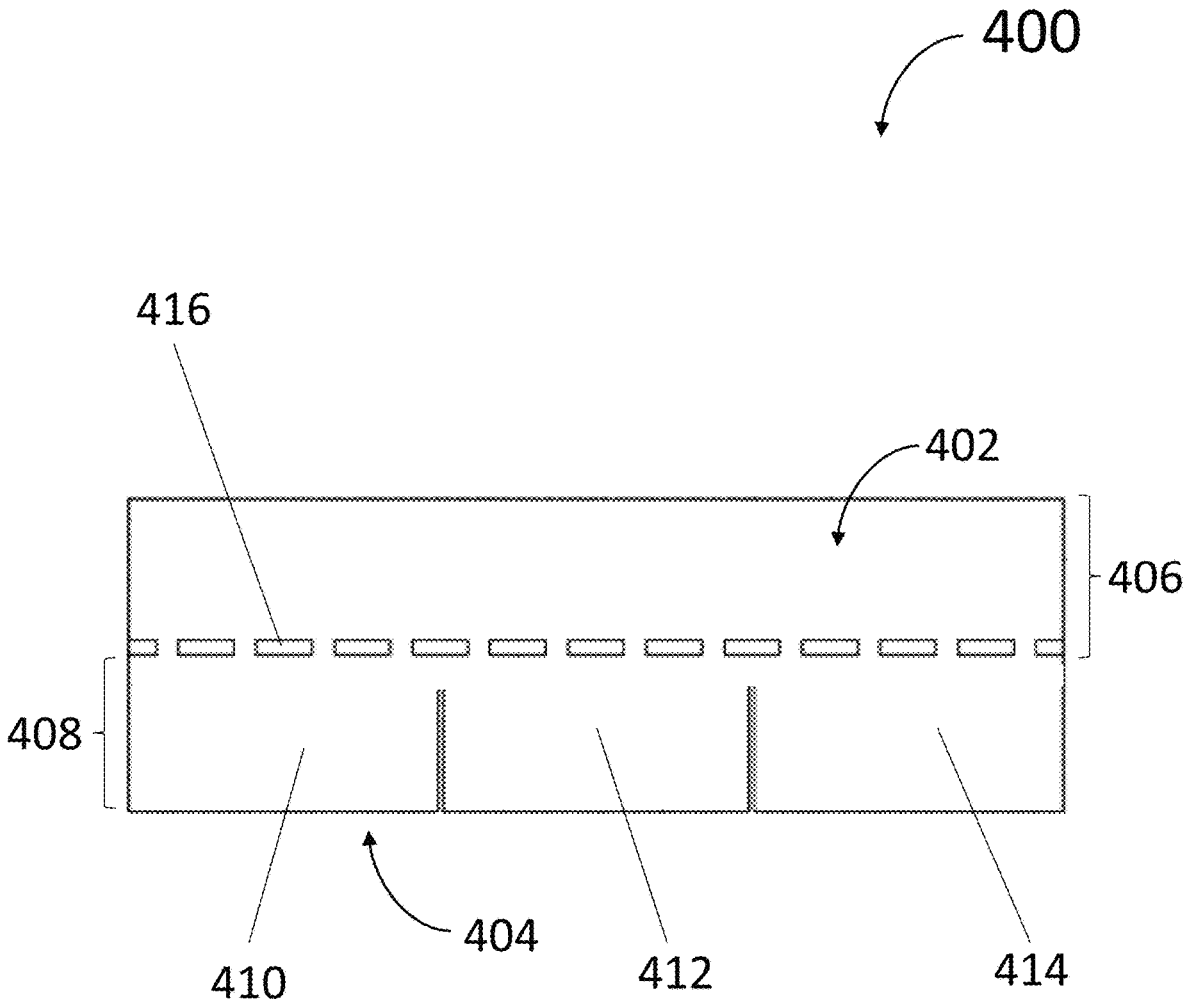
FIG. 4 is a schematic diagram of a front side of a roofing shingle, according to some embodiments.

FIG. 4 is a schematic diagram of a front side of a roofing shingle 400, according to some embodiments. In some embodiments, the roofing shingle 400 may be a strip shingle. Any of the asphalt shingle waste coatings and asphalt coatings of this disclosure may be used herein.

As shown in FIG. 4, in some embodiments, the roofing shingle 400 is a strip shingle. In some embodiments, the roofing shingle 400 comprises a sheet. In some embodiments, for example, the roofing shingle 400 is a single sheet. In some embodiments, the shingle sheet comprises a single layer or multiple layers (e.g., a composite material with multiple laminated layers, multiple extruded layers, or any combination thereof, which combine to form a single sheet). In some embodiments, the sheet has a top surface 402 and a back surface 404. In some embodiments, the sheet comprises a headlap 406 and a plurality of tabs 408 (e.g., such as for example tabs 410, 412, 414) extending from a side of the headlap 406. In some embodiments, the roofing shingle 400 comprises a line of sealant 416. In some embodiments, the top surface 402 or at least a portion of the top surface 402 (e.g., the plurality of tabs 408) is an exposed surface. In some embodiments, the back surface 404 is an unexposed surface.

Figure 5:
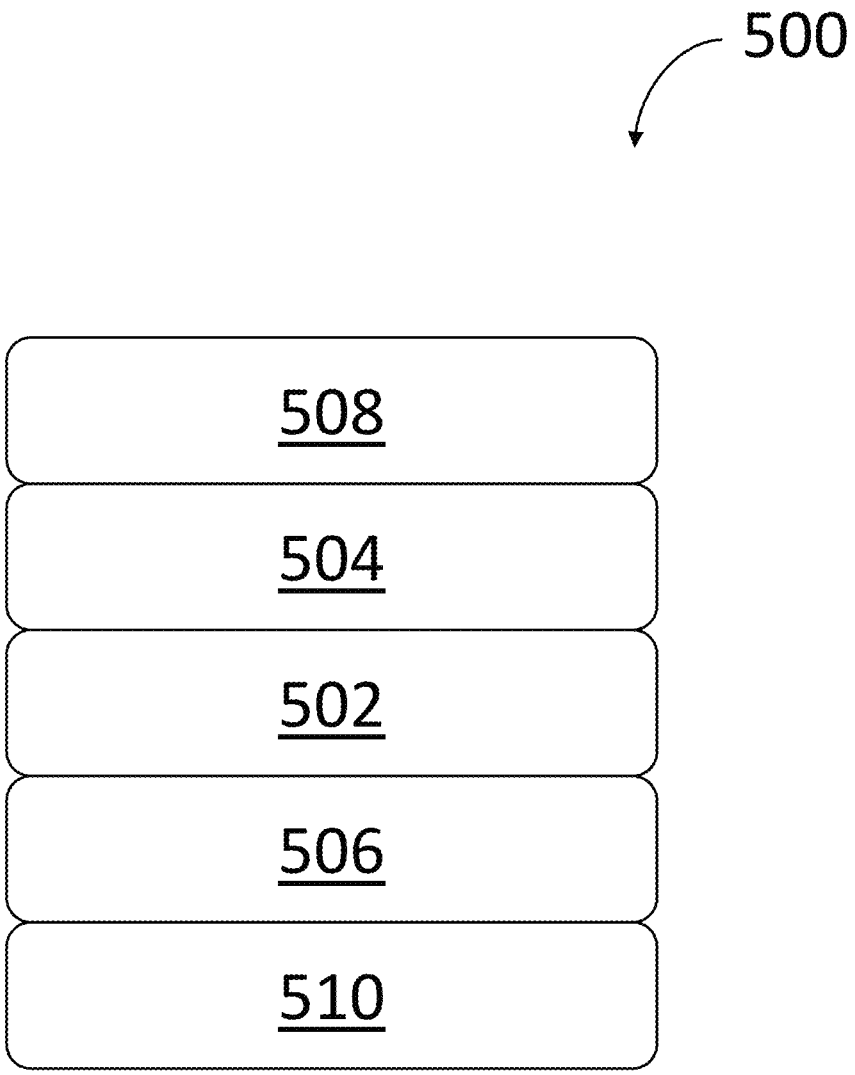
FIG. 5 is a schematic diagram of a cross-section of a roofing shingle, according to some embodiments.

FIG. 5 is a schematic diagram of a cross-section of a roofing shingle 500, according to some embodiments. Any of the asphalt shingle waste coatings and asphalt coatings of this disclosure may be used herein.

As shown in FIG. 5, in some embodiments, the roofing shingle 500 comprises, consists of, or consists essentially of at least one of a roof substrate 502, an asphalt shingle waste coating 504, an asphalt shingle waste coating 506, an asphalt coating 508, an asphalt coating 510, or any combination thereof. In some embodiments, the roof substrate 502 has a top surface and a bottom surface. In some embodiments, the roof substrate 502 comprises at least one of a fiberglass mat, a polyester mat, or any combination thereof. In some embodiments, the roofing shingle 500 comprises the asphalt shingle waste coating 504, 506 on at least one of the top surface of the roof substrate 502, the bottom surface of the roof substrate 502, or any combination thereof. For example, in some embodiments, the top surface of the roof substrate 502 comprises the asphalt shingle waste coating 504. In some embodiments, the bottom surface of the roof substrate 502 comprises the asphalt shingle waste coating 506. In some embodiments, the asphalt shingle waste coating 504 saturates all or a portion of the top surface of roof substrate 502, the bottom surface of the roof substrate 502, or the entire roof substrate 502. In some embodiments, the roofing shingle 500 comprises the asphalt coating 508, 510 on at least one of the top surface of the roof substrate 502, the bottom surface of the roof substrate 502, or any combination thereof. In some embodiments, the asphalt coating 508 covers all or a portion of the asphalt shingle waste coating 504 on the top surface of the roof substrate 502. In some embodiments, the asphalt coating 510 covers all or a portion of the asphalt shingle waste coating 506 on the bottom surface of the roof substrate 502. In some embodiments, the roofing shingle 500 does not comprise at least one of the asphalt shingle waste coating 504, the asphalt shingle waste coating 506, the asphalt coating 508, the asphalt coating 510, or any combination thereof.

Figure 6:
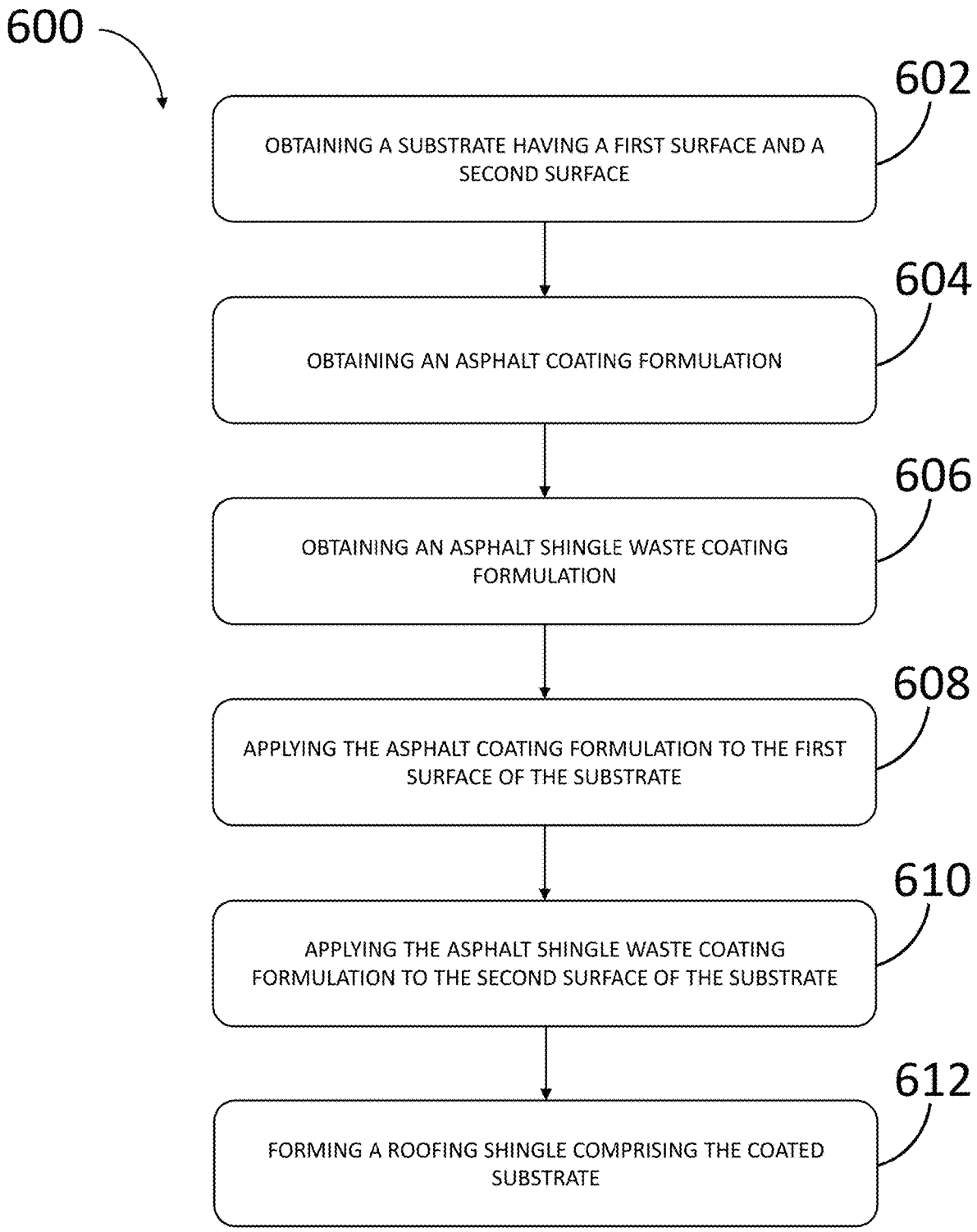
FIG. 6 is a flowchart of a method for making a roofing shingle, according to some embodiments.

FIG. 6 is a flowchart of a method for making a roofing shingle, according to some embodiments. Any of the asphalt shingle waste coatings and asphalt coatings of this disclosure may be used herein.

As shown in FIG. 6, in some embodiments, the method 600 for making a roofing shingle comprises a step 602 of obtaining a substrate. In some embodiments, the substrate has a first surface and a second surface. In some embodiments, the substrate comprises at least one of a fiberglass, a polyester, or any combination thereof. In some embodiments, the substrate comprises a fiberglass mat. In some embodiments, the fiberglass mat comprises a roll of a fiberglass mat.

In some embodiments, the method 600 comprises a step 604 of obtaining an asphalt coating formulation. In some embodiments, the method 600 comprises a step 606 of obtaining an asphalt shingle waste coating formulation. In some embodiments, the method 600 comprises a step 608 of applying the asphalt coating formulation to the first surface of the substrate. In some embodiments, the applying comprises coating the first surface of the substrate with the asphalt coating formulation. In some embodiments, the applying comprises pressing the asphalt coating formulation into the first surface of the substrate. In some embodiments, the method 600 comprises a step 610 of applying the asphalt shingle waste coating formulation to the second surface of the substrate. In some embodiments, the applying comprises coating the second surface of the substrate with the asphalt shingle waste coating formulation. In some embodiments, the applying comprises pressing the asphalt shingle waste coating formulation into the second surface of the substrate.

In some embodiments, the method 600 comprises step 612 of forming a roofing shingle comprising the coated substrate. In some embodiments, the roofing shingle comprises at least one of a laminated shingle, a strip shingle, or any combination thereof. In some embodiments, the forming comprises cutting the coated substrate to form the roofing shingle. In some embodiments, the method 600 comprises a step (not shown) of applying roofing granules to at least a portion of the first surface of the substrate.

The invention claimed is:

1. A roofing system comprising:

a roof substrate, wherein the roof substrate comprises at least one of a roof deck, an underlayment, or any combination thereof; and at least a first roofing shingle, a second roofing shingle, and a third roofing shingle on the roof substrate, wherein the first roofing shingle covers a portion of the second roofing shingle so as to define first unexposed surfaces and first exposed surfaces, wherein the second roofing shingle covers a portion of the third roofing shingle so as to define second unexposed surfaces and second exposed surfaces, wherein at least the first roofing shingle, the second roofing shingle, and the third roofing shingle comprise:

an asphalt shingle waste filled coating, wherein the asphalt shingle waste filled coating covers at least a portion of at least one of the first exposed surfaces, at least one of the second exposed surfaces, or any combination thereof, wherein the asphalt shingle waste filled coating comprises:

at least 50% by weight of at least one filler based on a total weight of the asphalt shingle waste filled coating, wherein the at least one filler comprises at least one of a recycled thermoplastic, a recycled rubber, a limestone, or any combination thereof; and an asphalt coating, wherein the asphalt coating covers at least a portion of the asphalt shingle waste filled coating;

wherein the asphalt coating is substantially free of an asphalt shingle waste.

2. The roofing system of claim 1, wherein the first roofing shingle, the second roofing shingle, and the third roofing shingle are strip shingles.

3. The roofing system of claim 1, wherein the first roofing shingle, the second roofing shingle, and the third roofing shingle are laminated shingles.

4. The roofing system of claim 1, wherein the asphalt coating is free of the asphalt shingle waste.

5. The roofing system of claim 1, wherein the asphalt shingle waste filled coating does not comprise an asphalt.

6. The roofing system of claim 1, wherein the asphalt shingle waste filled coating comprises at least 55% by weight of the at least one filler based on the total weight of the asphalt shingle waste filled coating.

7. The roofing system of claim 1, wherein the asphalt shingle waste filled coating comprises at least 60% by weight of the at least one filler based on the total weight of the asphalt shingle waste filled coating.

8. The roofing system of claim 1, wherein the asphalt shingle waste filled coating comprises at least 65% by weight of the at least one filler based on the total weight of the asphalt shingle waste filled coating.

9. The roofing system of claim 1, wherein the at least one filler is the recycled thermoplastic.

10. The roofing system of claim 1, wherein the at least one filler is the recycled rubber.

11. A roofing system comprising:

a roof substrate, wherein the roof substrate comprises at least one of a roof deck, an underlayment, or any combination thereof; and at least a first roofing shingle, a second roofing shingle, and a third roofing shingle on the roof substrate, wherein the first roofing shingle covers a portion of the second roofing shingle so as to define first unexposed surfaces and first exposed surfaces, wherein the second roofing shingle covers a portion of the third roofing shingle so as to define second unexposed surfaces and second exposed surfaces, wherein at least the first roofing shingle, the second roofing shingle, and the third roofing shingle comprise:

a first coating, wherein the first coating covers at least a portion of at least one of the first exposed surfaces, at least one of the second exposed surfaces, or any combination thereof, wherein the first coating comprises:

at least 50% by weight of at least one filler based on a total weight of the first coating, wherein the at least one filler comprises at least one of a recycled thermoplastic, a recycled rubber, or any combination thereof; and less than 5% by weight of an asphalt based on the total weight of the first coating; and an asphalt coating, wherein the asphalt coating covers at least a portion of the first coating;

wherein the asphalt coating is substantially free of an asphalt shingle waste.

12. The roofing system of claim 11, wherein the first roofing shingle, the second roofing shingle, and the third roofing shingle are strip shingles.

13. The roofing system of claim 11, wherein the first roofing shingle, the second roofing shingle, and the third roofing shingle are laminated shingles.

14. The roofing system of claim 11, wherein the asphalt coating is free of the asphalt shingle waste.

15. The roofing system of claim 11, wherein the first coating does not comprise the asphalt.

16. The roofing system of claim 11, wherein the first coating comprises at least 55% by weight of the at least one filler based on the total weight of the first coating.

17. The roofing system of claim 11, wherein the first coating comprises at least 60% by weight of the at least one filler based on the total weight of the first coating.

18. The roofing system of claim 11, wherein the first coating comprises at least 65% by weight of the at least one filler based on the total weight of the first coating.

19. The roofing system of claim 11, wherein the at least one filler is the recycled thermoplastic.

20. The roofing system of claim 11, wherein the at least one filler is the recycled rubber.

* * * * *